US008887472B2

(12) United States Patent
Vanker et al.

(10) Patent No.: US 8,887,472 B2
(45) **Date of Patent: *Nov. 18, 2014**

(54) PANELIZED STRUCTURAL SYSTEM FOR BUILDING CONSTRUCTION

(71) Applicant: Patco, LLC, Lac du Flambeau, WI (US)

(72) Inventors: John Louis Vanker, Denver, CO (US); Michael J. Lastowski, Centennial, CO (US)

(73) Assignee: Patco, LL, Lac Du Flambeau, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/014,690

(22) Filed: Aug. 30, 2013

(65) Prior Publication Data

US 2014/0000208 A1 Jan. 2, 2014

Related U.S. Application Data

(62) Division of application No. 12/964,380, filed on Dec. 9, 2010, now Pat. No. 8,528,294.

(60) Provisional application No. 61/288,011, filed on Dec. 18, 2009.

(51) Int. Cl.

| | |
|---|---|
| ***E04C 3/02*** | (2006.01) |
| ***E04B 1/19*** | (2006.01) |
| ***E04B 1/18*** | (2006.01) |
| *E04B 1/24* | (2006.01) |

(52) U.S. Cl.

CPC ..... *E04B 1/1903* (2013.01); *E04B 2001/246* (2013.01); *E04B 1/24* (2013.01); *E04B 2001/2448* (2013.01); *E04B 2001/2496* (2013.01); *E04B 2001/2415* (2013.01); *E04B 2001/2454* (2013.01); *E04B 1/185* (2013.01)

USPC ..... 52/690; 52/262; 52/694

(58) Field of Classification Search

USPC ..... 52/690, 693, 694, 695, 270, 582.1, 52/236.7, 262, 266, 236.3

See application file for complete search history.

(56) References Cited

U.S. PATENT DOCUMENTS

| | | | | |
|---|---|---|---|---|
| 4,656,792 | A * | 4/1987 | Clark | 52/93.1 |
| 5,657,606 | A * | 8/1997 | Ressel et al. | 52/690 |
| 6,067,769 | A * | 5/2000 | Hardy | 52/693 |
| 6,308,469 | B1 * | 10/2001 | Leung | 52/167.3 |
| 6,389,778 | B1 * | 5/2002 | Strange | 52/745.19 |
| 6,460,297 | B1 * | 10/2002 | Bonds et al. | 52/79.1 |

(Continued)

FOREIGN PATENT DOCUMENTS

| | | |
|---|---|---|
| CN | 2417227 Y | 1/2001 |
| CN | 1478971 A | 3/2004 |

*Primary Examiner* — Jeanette E Chapman

*Assistant Examiner* — Daniel Kenny

(74) *Attorney, Agent, or Firm* — Mark J. Nahnsen; Barnes & Thornburg LLP

(57) ABSTRACT

A method of constructing a building includes fastening a first structural truss panel to a first structural column. A second structural column is fastened vertically to the first structural column. A second structural truss panel is fastened to the second structural column so that the second structural truss panel is vertically above the first structural truss panel, so that a clearance is defined between the first and second structural truss panels, and so that loads on the structural truss panels are transferred from the first and second structural truss panels to the first and second structural columns and then vertically between the first and second columns. Other construction methods, structural panels, and building sections are also disclosed.

34 Claims, 19 Drawing Sheets

(56) References Cited

U.S. PATENT DOCUMENTS

| | | | | |
|---|---|---|---|---|
| 6,761,001 | B2 * | 7/2004 | Mueller | 52/167.3 |
| 7,634,888 | B2 * | 12/2009 | Cloyd et al. | 52/653.1 |
| 7,739,850 | B2 * | 6/2010 | Daudet | 52/656.2 |
| 2005/0210762 | A1 * | 9/2005 | Broberg | 52/79.1 |
| 2009/0044480 | A1 * | 2/2009 | Bonds | 52/653.2 |
| 2011/0047889 | A1 * | 3/2011 | Gad et al. | 52/79.1 |
| 2011/0146180 | A1 * | 6/2011 | Klein | 52/317 |

* cited by examiner

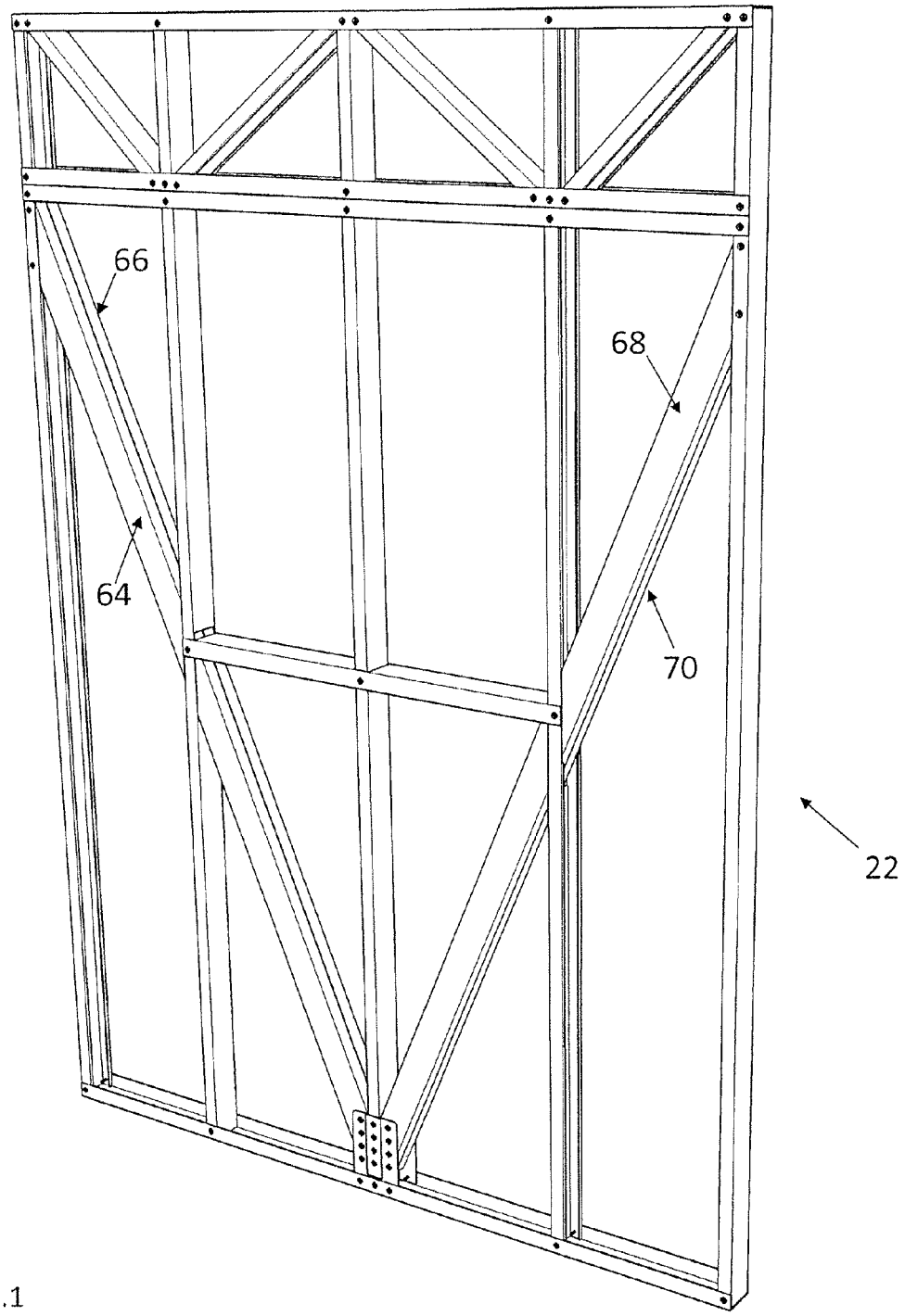
Figure 3.1

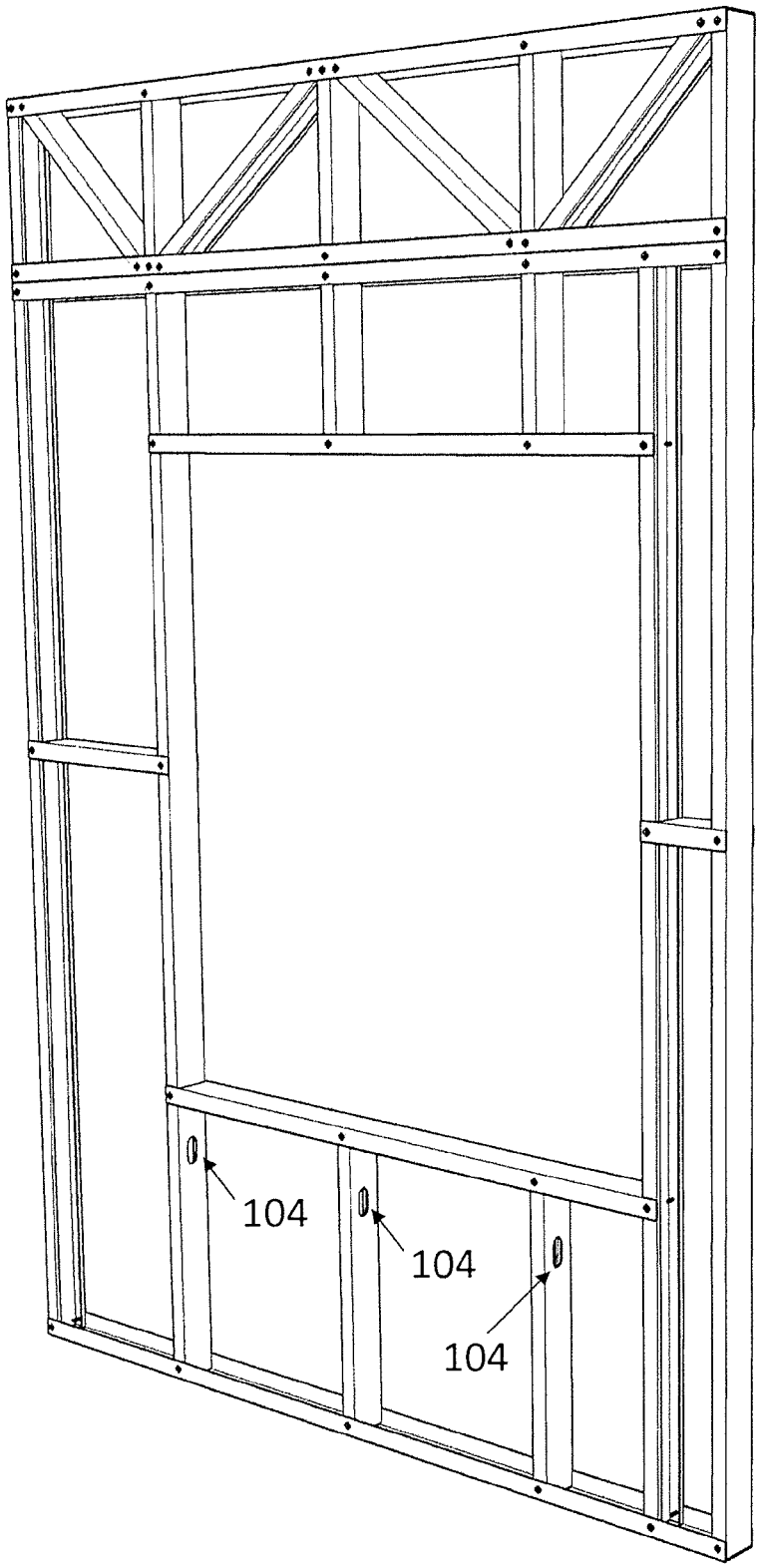
Figure 4.1

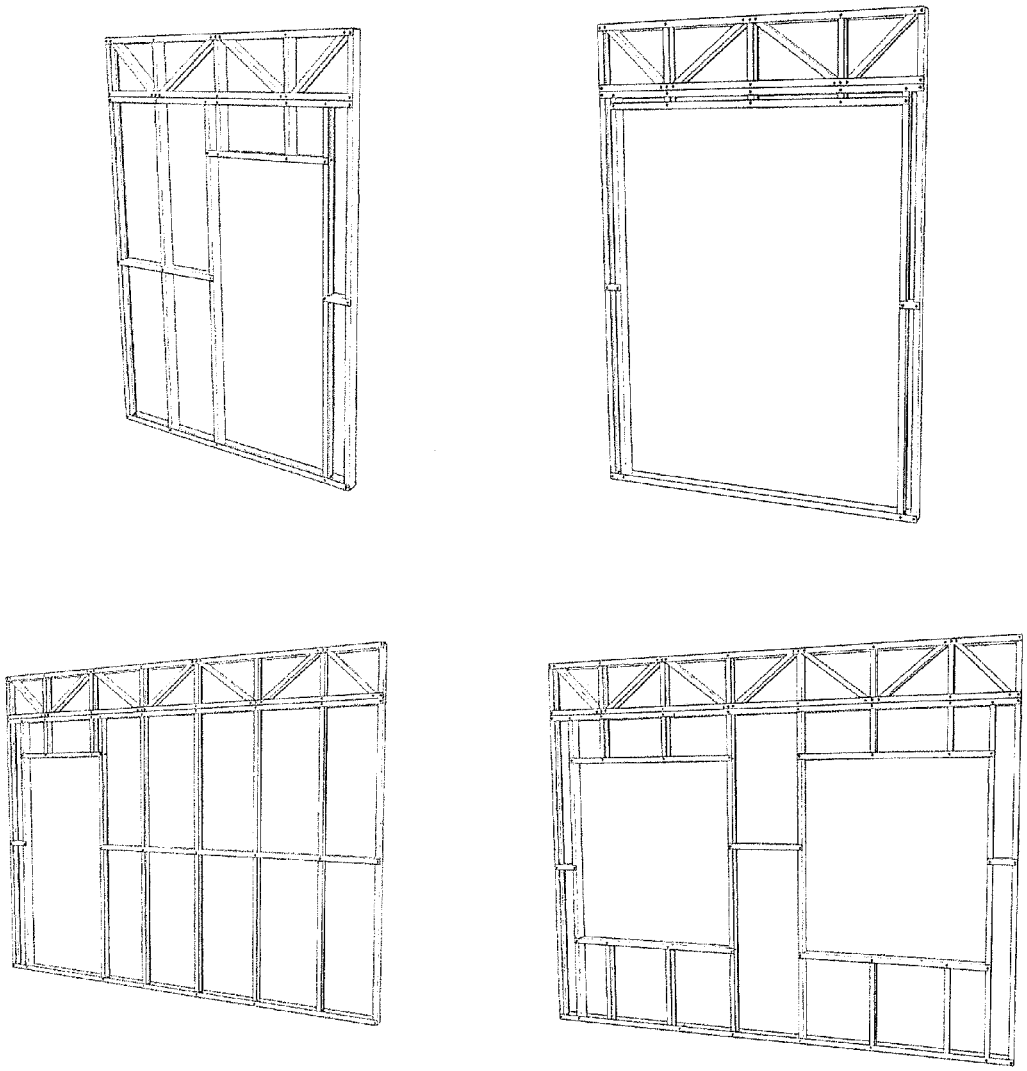
Figure 4.2 - Open Horizontal Truss Panels

PANELIZED STRUCTURAL SYSTEM FOR BUILDING CONSTRUCTION

RELATED APPLICATIONS

This application is a divisional of prior U.S. application Ser. No. 12/964,380, filed on Dec. 9, 2010, which claims the benefit of U.S. Provisional Application No. 61/288,011 filed on Dec. 18, 2009, both of which are incorporated herein by reference in their entirety.

TECHNICAL FIELD

The present disclosure relates to a panelized and modular system for constructing and assembling buildings.

BACKGROUND

A building's structure must withstand physical forces or displacements without danger of collapse or without loss of serviceability or function. The stresses on buildings are withstood by the buildings' structures.

Buildings five stories and less in height typically use a "bearing wall" structural system to manage dead and live load vertical forces. Vertical forces on the roof, floors, and walls of a structure are passed vertically from the roof to the walls to the foundation by evenly spreading the loads on the walls and by increasing the size and density of the framing or frame structure from upper floors progressively downward to lower floors, floor-to-floor. For ceilings and floor spans, trusses are used to support loads on the ceilings and floors and to transfer these loads to walls and columns.

Where vertical bearing elements are absent, for example at window and door openings, beams are used to transfer loads to columns or walls. In buildings taller than five stories, where the walls have limited capacity to support vertical loads, concrete and/or structural steel framing in the form of large beams and columns are used to support the structure.

Lateral forces (e.g., wind and seismic forces) acting on buildings are managed and transferred by bracing. A common method of constructing a braced wall line in buildings (typically 5 stories or less) is to create braced panels in the wall line using structural sheathing. A more traditional method is to use let-in diagonal bracing throughout the wall line, but this method is not viable for buildings with many openings for doors, windows, etc. The lateral forces in buildings taller than five stories are managed and transferred by heavy steel let-in bracing, or heavy steel and/or concrete panels, as well as structural core elements such as concrete or masonry stair towers and elevator hoistways.

There is a need for a panelized and modular system for constructing and assembling buildings without relying on concrete and/or structural steel framing, heavy steel let-in bracing, and heavy steel and/or concrete panels.

DETAILED DESCRIPTION

The Unified Truss Construction System (UTCS) disclosed herein is a unique, new, and innovative structural system for single and multistory buildings, based on standardized structural panels. The system employs a limited number of configurations of uniquely engineered, light gauge metal framed vertical wall panels (horizontal truss panels), light-gauge-metal floor and ceiling trusses, cold rolled square or rectangular steel tubing (structural columns), and unique connecting plates and clips.

Unlike conventional approaches to designing and engineering a building's structure, where many different assemblies (walls, columns, beams, bracing, strapping, and the fasteners that fasten them together) are employed to manage vertical live load and dead load forces, and lateral forces, UTCS manages these forces through a limited number of uniquely designed standardized horizontal truss panels, which are assembled with structural columns and trusses. This unique assembly of elements effectively supports and transfers vertical and lateral forces from the walls, floor, ceiling, and roof to UTCS' redundant and dense column system. Accordingly, columns absorb these vertical and lateral forces such that UTCS is not a vertical bearing wall structural system and eliminates the need for "hot formed" structural steel (weighted steel or "red iron") and concrete as part of a building's structural system.

UTCS framing members are made from specially designed computerized roll forming machines. These machines manufacture framing studs or members from cold rolled steel commonly referred to as "coiled steel." Each stud is cut to size, pre-drilled for fastening screws, with countersinks at the assembly screw head area, pre-punched for chasing mechanical, electrical, and plumbing ("MEP") assemblies and rough-ins, pre-punched for passing vertical and horizontal bracing, and labeled for assembly. The machines read stud specifications from CAD files.

Horizontal truss panels and the trusses used in UTCS are constructed with framing members roll formed from light gauge steel, such as 18 to 14 gauge steel, depending on building height and code requirements. There are two profiles of framing members used in the horizontal truss panels, a stud 10 illustrated in FIG. 1 and a track 12 illustrated in FIG. 2. The stud 10 and the track 12 are each rolled from light gauge steel, such as 18 to 14 gauge steel.

Figures 1, 2:
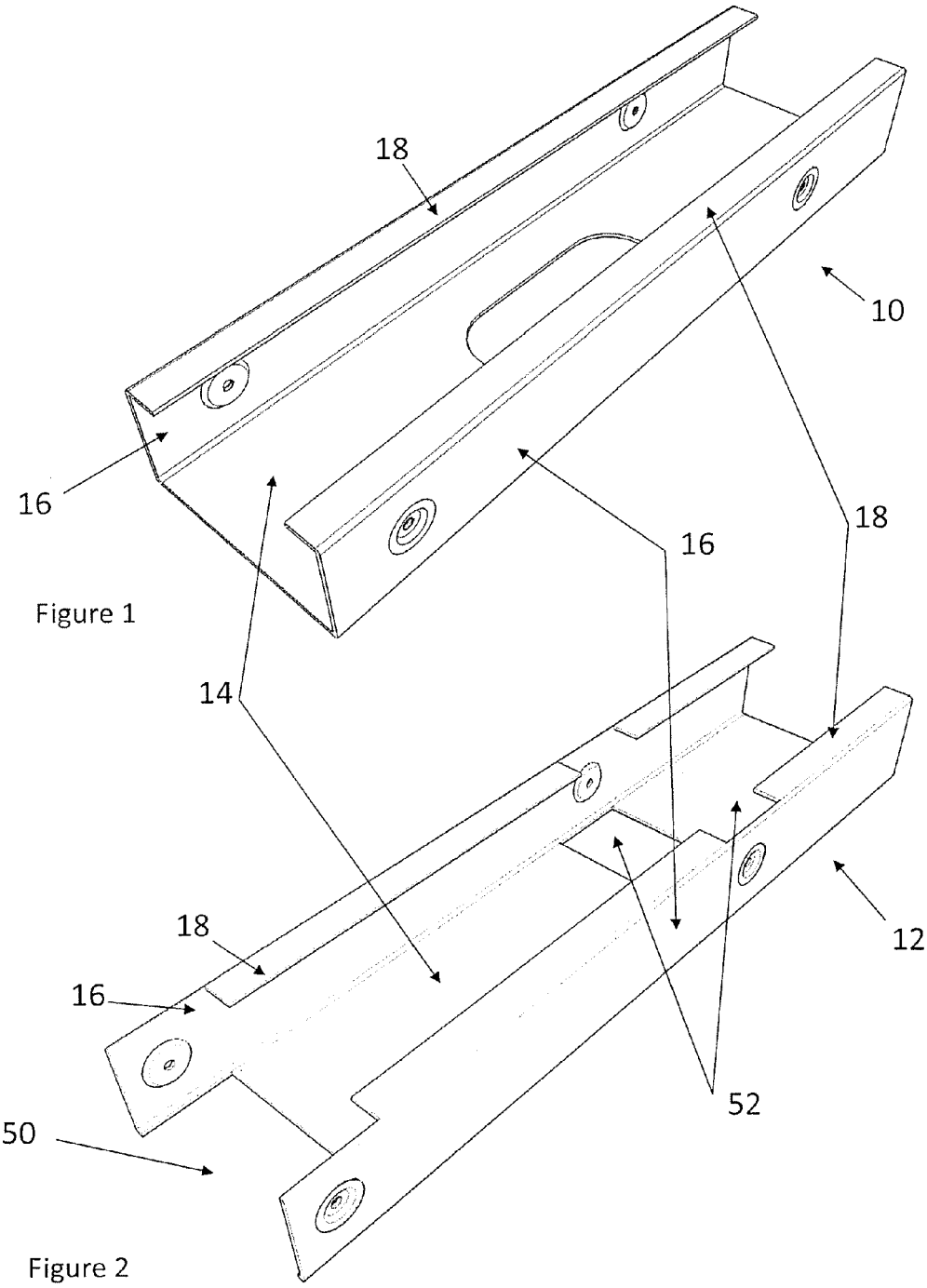
FIG. 1 illustrates a stud for use as a framing member in horizontal truss panels.
FIG. 2 illustrates a track for use as a framing member in horizontal truss panels.

Each of the stud 10 and the track 12 includes a web 14, flanges 16, and lips 18 formed as illustrated in FIG. 1. The flanges 16 extend in the same direction at substantially right angles from opposing sides of the web 14, and the lips 18 extend inwardly from ends of the flanges 16 such that the lips 18 parallel the web 14. The stud 10 and the track 12 differ mainly in that the flanges 16 of the track 12 are slightly higher than the flanges 16 of the stud 10, and the web 14 of the track 12 is slightly wider than the web 14 of the stud 10. These relative dimensions allow the stud 10 to slide into or through the track 12 without the need to compress the flanges 16 of the stud 12, which affects its structural performance.

UTCS employs a limited number, such as two, configurations of horizontal truss panels. These horizontal truss panels are the structural wall elements of UTCS. If only two such configurations are used, they are (a) a V-braced horizontal truss panel 20/22 shown in FIG. 3 or FIG. 3.1, which contains a "V" shaped brace ("V-brace"), and (b) an open horizontal truss panel 24 shown in FIG. 4, which does not contain a V-brace.

An open horizontal truss panel 24 is generally used in any area of a building having large openings (windows, doors, pass-throughs, and the like) in a UTCS structure. The open horizontal truss panel 24 is engineered to support and transfer vertical live (occupancy, for example) and dead load forces (e.g., drywall, MEP assemblies, insulation, and the like) from floor and ceiling assemblies attached either to or proximate to each panel within a building ("Local Forces"). The V-braced horizontal truss panel 20/22 is engineered to support vertical local forces and lateral forces acting on the structure (wind and seismic, for example).

Figure 3:
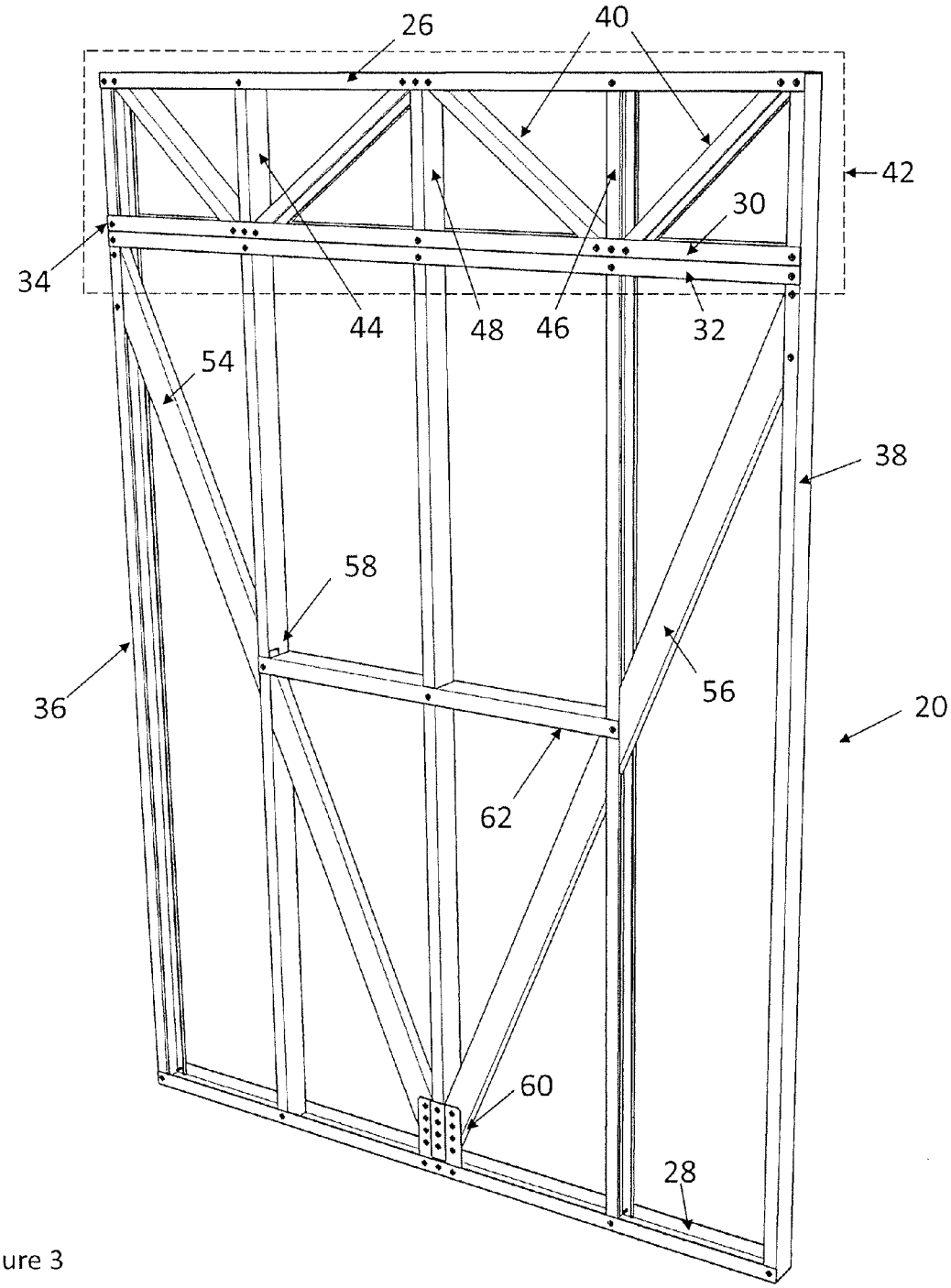
FIGS. 3 and 3.1 illustrate a V-Braced horizontal truss panel.

As shown in FIG. 3, the V-braced horizontal truss panel 20 has a top track 26 and a bottom track 28. Inboard of the top track 26 is a continuous horizontal brace comprised of back-to-back (web-to-web) tracks 30 and 32, (referred to as double horizontal bracing), which are anchored by fasteners 34 such as bolts or screws to side studs 36 and 38 at the sides of the V-braced horizontal truss panel 20. The top track 26 and the bottom track 28 are also anchored by fasteners 34 to the side studs 36 and 38. The area between the continuous horizontal brace formed by the tracks 30 and 32 and the top track 26 contains vertical angled webbing 40 made from studs. This braced area in FIG. 3 acts as a truss attachment area 42 within the V-braced horizontal truss panel 20 for the attachment of trusses 106 discussed below, and supports and transfers forces exerted on the V-braced horizontal truss panel 20 to the structural columns discussed below and attached to each of the side studs 36 and 38 of the V-braced horizontal truss panel 20.

The V-braced horizontal truss panel 20 also has two inboard studs 44 and 46 and a center stud 48 anchored by fasteners 34 to the top and bottom tracks 26 and 28 and to the tracks 30 and 32. The side studs 36 and 38 pass through end cutouts 50 in the ends of the web 14 and in the lips 18 of the tracks 30 and 32 such that the flanges 16 of the studs 36 and 38 abut the flanges 16 at the ends of the tracks 26, 28, 34, and 36. These end cutouts 50 are shown in FIG. 2. The fasteners 34 are at these abutment areas. Similarly, the inboard studs 44 and 46 and the center stud 48 pass through interior cutouts 52 of the webs 14 and lips 18 of the tracks 30 and 32 such that an exterior of the flanges 16 of the studs 36 and 38 and of the center stud 100 abut the interior of the flanges 16 of the tracks 26, 28, 34, and 36. These interior cutouts 52 are also shown in FIG. 2. The fasteners 34 are at these abutment areas. The five vertical studs 36, 38, 44, 46, and 48, for example, may be spaced 24" on center. The point at which the inboard studs 44 and 46 and the center stud 48 pass through the tracks 30 and 32 is a hinge connection (i.e., a single fastener allows for rotation). The studs of the V-braced horizontal truss panel 20 also serve to support drywall, conduit, wiring, plumbing assemblies, etc.

The V-braced horizontal truss panel 20 also contains a continuous V-shaped bracing. This V-Bracing is unique in its design and engineering. The two legs of the V-brace are V-brace studs 54 and 56 such as the stud 10 shown in FIG. 1. The V-brace stud 54 is anchored to the side stud 36 just below the tracks 30 and 32 and to the bottom track by the fasteners 34 and passes through an interior cutout 58 in the web 14 of the inboard stud 44. This interior cutout 58 is shown in FIG. 1. The web 14 of the V-brace stud 54 abuts one flange 16 of each of the studs 36 and 44 and the track 28. These abutment areas receive the fasteners 34 as shown.

Similarly, the V-brace stud 56 is anchored to the side stud 38 just below the tracks 30 and 32 and to the bottom track 28 by the fasteners 34 and passes through the interior cutout 58 in the inboard stud 46. The web 14 of the V-brace stud 56 abuts one flange 16 of each of the studs 38 and 46 and the track 28. These abutment areas receive the fasteners 34 as shown.

The attachment of the V-brace studs 54 and 56 to the studs 36 and 38 and to the track 28 require that the ends of the V-brace studs 54 and 56 be angles as shown in FIG. 3. These angled ends permit multiple fasteners 34 to be used to anchor the V-brace studs 54 and 56 to their corresponding side studs 36 and 38.

The V-brace studs 54 and 56 are positioned with their webs perpendicular to the webs of the studs 36, 44, 48, and 38 of the V-braced horizontal truss panel 20. Also, the V-brace studs 54 and 56 run continuously from immediately below the tracks 32 and 34 through the inboard studs 44 and 46 to the apex of a "V" at substantially the middle of the bottom track 28. The connection at the apex of the V-bracing is facilitated by an apex plate 60 and additional fasteners 34, which interconnect the V-brace studs 54 and 56 and the center stud 48. The plate 60, the bottom track 28, and the stud 48 and the V-brace studs 54 and 56 are interconnected by the lower three fasteners as shown in FIG. 3. The inboard stud 46 is also attached by fasteners 34 to the top track 26 and to the tracks 30 and 32 at the point where the inboard stud 46 passes through the interior cutouts 52 in the tracks 30 and 32. The apex plate 60 may be formed from a material such as 18-14 gauge cold roll steel.

The connections of the V-brace studs 54 and 56, to the side studs 36 and 38, to the center stud 48, and to the track 28 are moment connections and improve the lateral structural performance of the V-braced horizontal truss panel 20.

These connections facilitate the transfer of most of the lateral forces acting on the V-braced horizontal truss panel 20 to the structural column of the system (discussed in further detail below).

The V-braced horizontal truss panel 20 also contains a track 62 providing horizontal bracing. The track 62 is located, for example, mid-way in the V-Brace formed by the V-brace studs 54 and 56. The track 62 has the end cutouts to accommodate the inboard studs 44 and 46, has the interior cutout 52 to accommodate the center stud 48, and is anchored by fasteners 34 to the inboard studs 44 and 46 and to the center stud 48. The track 62 contributes to the lateral-force structural performance of the V-braced horizontal truss panel 20.

The V-braced horizontal truss panel 20 may contain other bracing and backing as necessary for building assemblies like drywall, cabinets, grab bars and the like. The V-braced horizontal truss panel 20 is used as both interior (demising and partition) structural walls and exterior structural walls. The V-braced horizontal truss panel 20/22 may also accommodate windows and pass-throughs, although the space is limited as can be seen from the drawings.

The V-braced horizontal truss panel 22 of FIG. 3.1 has the same construction as the V-braced horizontal truss panel 20 of FIG. 3 except that the V-brace stud 54 forming half of the V-brace of FIG. 3 is replaced by two studs 64 and 66 whose lips 18 abut one another, and the V-brace stud 56 forming the other half of the V-brace of FIG. 3 is replaced by two studs 68 and 70 that may or may not abut one another. Thus, the studs 64, 66, 68, and 70 form a double V-brace for the V-braced horizontal truss panel 22 of FIG. 3.1 to provide extra strength.

Figure 4:
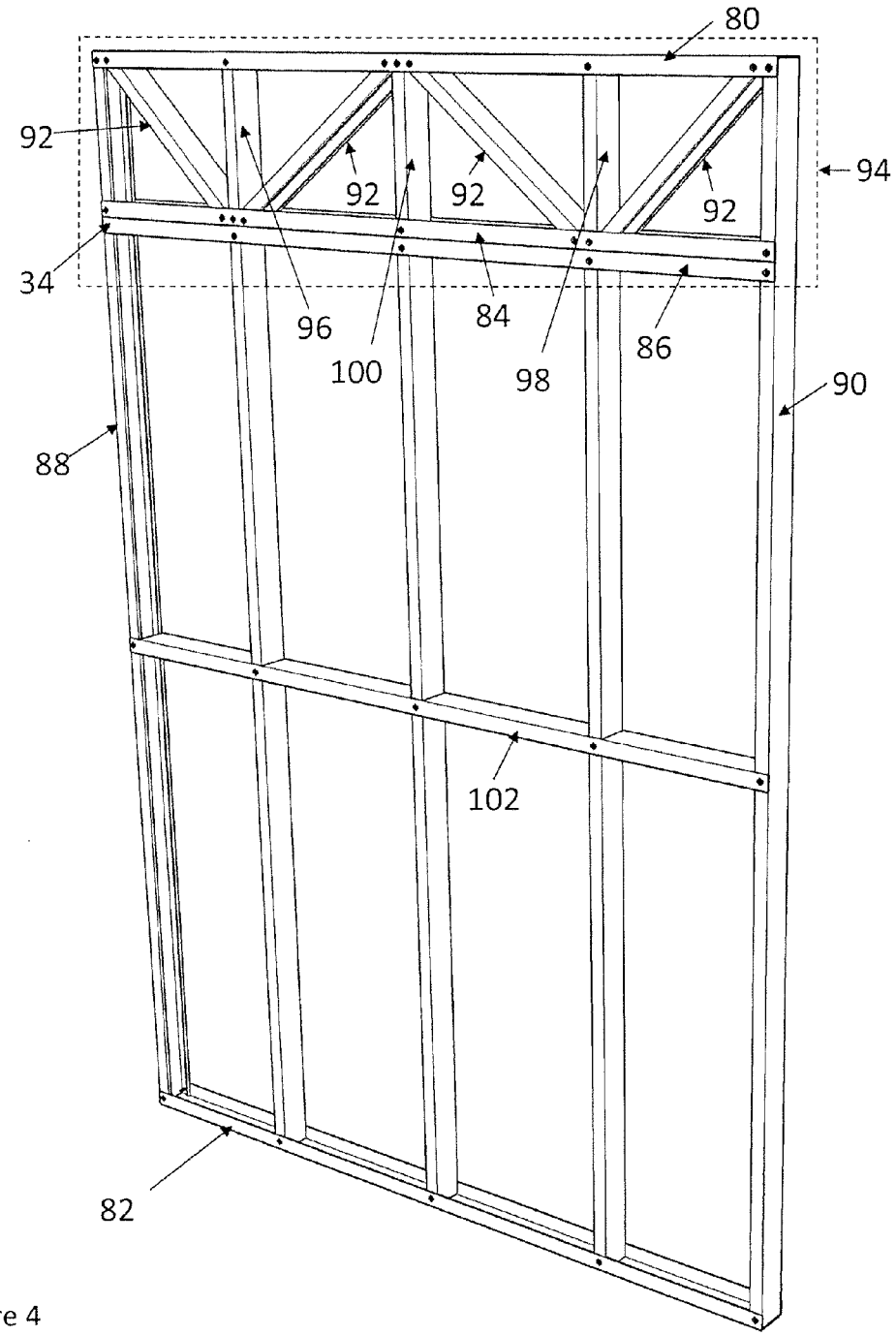
FIGS. 4, 4.1, and 4.2 illustrate various open horizontal truss panels.

As shown in FIG. 4, the open horizontal truss panel 24 has a top track 80 and a bottom track 82. Inboard of the top track 80 is a continuous horizontal brace comprised of back-to-back (web-to-web) tracks 84 and 86, (referred to as double horizontal bracing), which are anchored by fasteners 34 such as bolts or screws to side studs 88 and 90 at the sides of the open horizontal truss panel 24. The top track 80 and the bottom track 82 are also anchored by fasteners 34 to the side studs 88 and 90. The area between the continuous horizontal brace formed by the tracks 84 and 86 and the top track 80 contains vertical angled webbing 92 made from studs. This braced area in FIG. 4 acts as a structural truss 94 for the open horizontal truss panel 24, and supports and transfers forces exerted on the open horizontal truss panel 24 to the structural columns discussed below and attached to each of the side studs 88 and 90 of the open horizontal truss panel 24.

The open horizontal truss panel 24 also has two inboard studs 96 and 98 and a center stud 100 anchored by fasteners 34 to the top and bottom tracks 80 and 82 and to the tracks 84 and 86. The side studs 88 and 90 pass through end cutouts 50 in the ends of the web 14 and of the lips 18 of the tracks 84 and 86 such that the flanges 16 of the studs 88 and 90 abut the flanges 16 at the ends of the tracks 80, 82, 84, and 86. These end cutouts 50 are shown in FIG. 2. The fasteners 34 are at these abutment areas. Similarly, the inboard studs 96 and 98 and the center stud 100 pass through interior cutouts 52 of the webs 14 and of the lips 18 of the tracks 84 and 86 such that the flanges 16 of the studs 96 and 98 and of the center stud 100 abut the flanges 16 of the tracks 80, 82, 84, and 86. These interior cutouts 52 are also shown in FIG. 2. The fasteners 34 are at these abutment areas. The five vertical studs 88, 90, 96, 98, and 100, for example, may be spaced 24" on center. The point at which the inboard studs 96 and 98 and the center stud 100 pass through the tracks 84 and 86 is a hinge connection (i.e., a single fastener allows for rotation). The studs of the open horizontal truss panel 24 also serve to support drywall, conduit, wiring, plumbing assemblies, etc.

The open horizontal truss panel 24 also contains a track 102 performing horizontal bracing. The track 102 is located, for example, mid-way between the tracks 82 and 86. The horizontal bracing track 102 includes the end cutouts 50 through which the side studs 88 and 90 pass, has three interior cutouts 52 through which the inboard studs 96 and the center stud 100 pass, and is anchored by fasteners 34 to the side studs 88 and 90, to the inboard studs 44 and 46, and to the center stud 48. The flanges 16 of the studs 88, 90, 96, 98, and 100 abut the flanges 16 of the track 102. The fasteners 34 are applied to these abutment areas. The open horizontal truss panel 24 is engineered to handle vertical local forces.

The open horizontal truss panel 24 is designed to accommodate windows, doors, and pass-throughs. The open horizontal truss panel 24, for example, may be 20' wide or less. FIGS. 4.1 and 4.2 illustrate open horizontal truss panels with one or more openings for windows, doors, and pass-throughs. FIG. 4.1 illustrates typical chase openings 104 through which MEP assemblies may be passed. These chase holes 104 may be formed in the V-braced horizontal truss panels 20 and 22 as well. FIG. 4.2 illustrates several open horizontal truss panels with openings for doors.

The open horizontal truss panel 24 may contain other bracing and backing as necessary for building assemblies like windows, doors, pass throughs, drywall, cabinets, grab bars and the like. The open horizontal truss panel 24 is used as both interior (demising and partition) structural walls and exterior structural walls.

Figure 5:
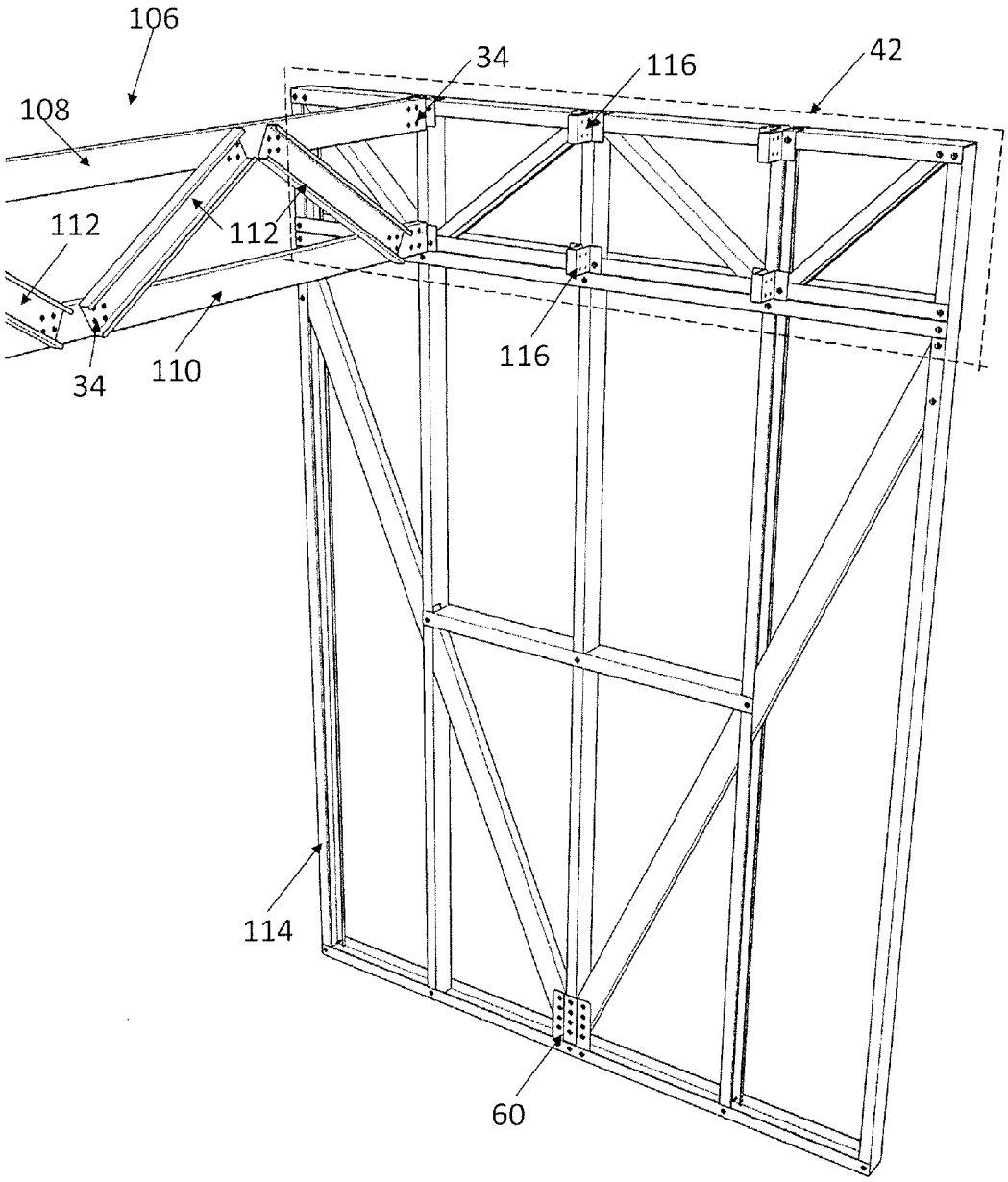
FIG. 5 illustrates a truss for attachment to horizontal truss panels.

The horizontal truss panels described above are tall enough to accommodate the floor to ceiling areas of buildings, and to accommodate attachment of trusses, such as a truss 106 shown in FIG. 5. The truss 106 is attached to the truss attachment area 42 and includes a top stud 108 and a bottom stud 110 interconnected by an angled webbing 112 made from studs such that the angled webbing 112 is attached to the top and bottom studs 108 and 110 by the fasteners 34. The truss 106 is attached to the truss attachment area 42 of a horizontal truss panel 114 by use of truss/stud hangars 116 and the fasteners 34. Although the horizontal truss panel 114 is shown as the V-braced horizontal truss panel 20/22, the horizontal truss panel 114 can be any of the horizontal truss panels described herein. The truss/stud hangars 116 are discussed more fully below in connection with FIG. 11.

The truss hangars 116 may be formed from a material such as 18-14 gauge cold roll steel.

Figure 10:
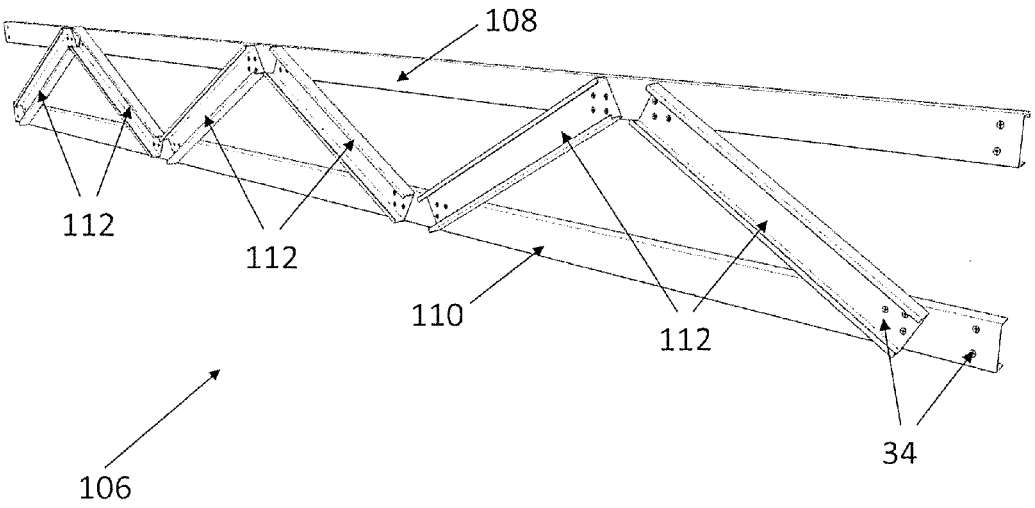
FIG. 10 illustrates the truss of FIG. 5.

The truss 106 is also shown in FIG. 10. Trusses used in UTCS are made from the studs 10. These trusses have the top and bottom studs 108 and 110 and the internal angled webbing 112. The trusses 106 do not have side or end webbing connecting their top and bottom chords 108 and 110. The truss 106 may be formed from light gauge steel, such as 18 to 14 gauge steel. The gauge and length of the truss 106 varies depending on application and width of floor span.

Figure 6:
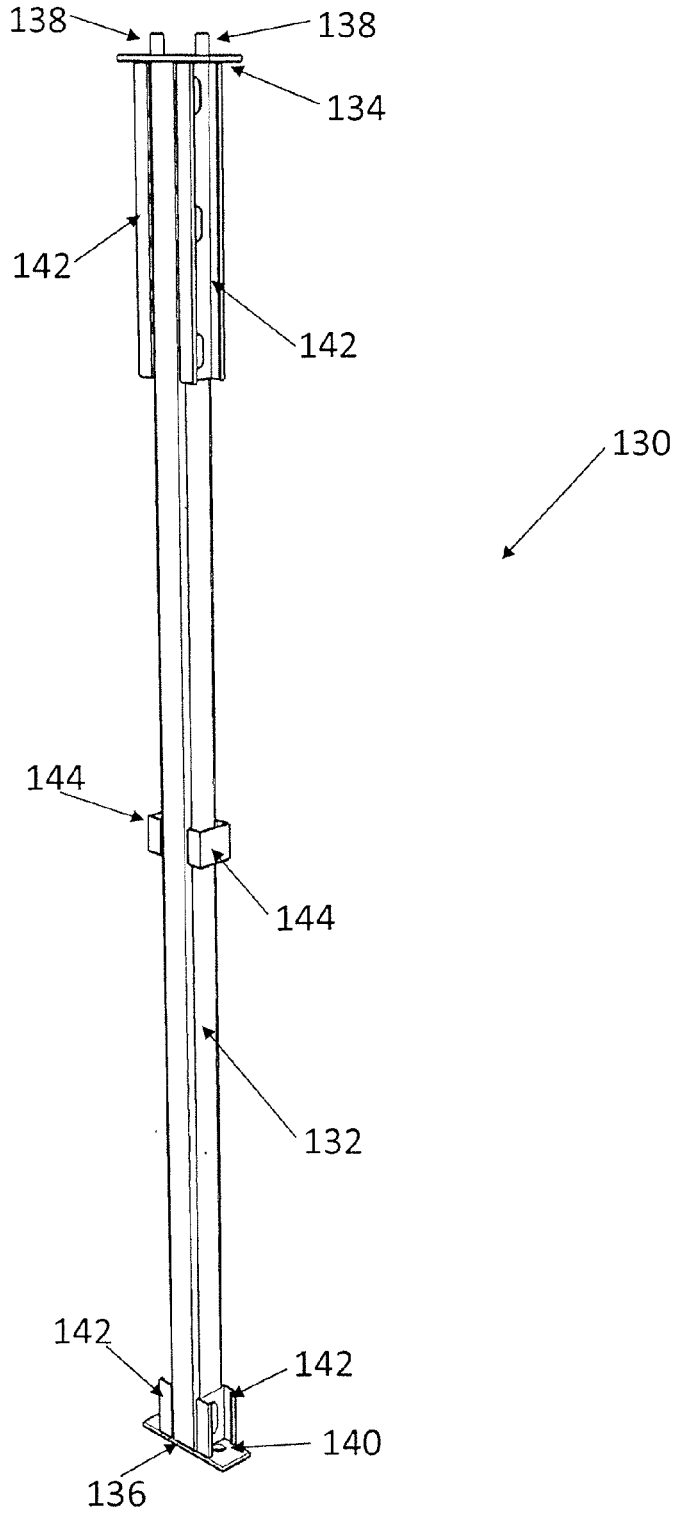
FIG. 6 illustrates a structural column assembly for attaching horizontal truss panels to one another.

FIG. 6 illustrates a structural column assembly 130 that includes a structural column 132 having a top plate 134 and a bottom plate 136 welded to the top and bottom of the structural column 132 so that the top plate 134 covers the top of the structural column 132 and the bottom plate 136 covers the bottom of the structural column 132. The structural column 132, for example, may be four sided, may be hollow, and may vary in wall thickness depending on building height and code requirements. The top plate 134 and the bottom plate 136 are shown in FIG. 6 as being linear in the horizontal direction and are used where two walls are joined side-by-side so as to share a common linear horizontal axis. However, the top plate 134 and the bottom plate 136 may be "L" shaped plates when two walls are to be joined at a corner such that the horizontal axes of the two walls are perpendicular to one another.

One or more bolts 138 are suitably attached (such as by welding or casting) to the top plate 134. The bolts 138 extend away from the top plate 134 at right angles. Each end of the bottom plate 136 has a hole 140 therethrough. Accordingly, a first structural column 132 can be stacked vertically on a second structural column 132 such that the bolts 138 of the top plate 134 of the second structural column 132 pass through the holes 140 of the bottom plate 136 of the first structural column 132. Nuts may then be applied to the bolts 138 of the top plate of the second structural column 132 and tightened to fasten the first and second structural columns 132 vertically to one another.

The top and bottom plates 134 and 136 are slightly wider than the track 12 used for the horizontal truss panel 20/22/24 and vary in thickness depending on building height and code requirements. The through-bolting provided by the bolts 138 and holes 140 permit the structural columns 132 to be connected to one another vertically and to other assemblies within a building (roof, foundations, garages, etc.).

The structural columns 132 are connected to horizontal truss panels 20/22/24 by way of stud sections 142 of the stud 10. The stud sections 142 are welded or otherwise suitably fastened to the top and bottom of the structural column 132. A stud section 144 is fastened by weld or suitable fastener at about the middle of the structural column 130 such that its web 14 faces outwardly. This stud section 144 is a "hold-off" to keep the studs 36, 38, 88, and 90 of the horizontal truss panels from deflecting.

Unification plates such as 154 may or may not be used at this location.

The material of the structural column 132, for example, is cold rolled steel. The structural column 132 may be hollow and have a wall thickness that varies depending on application and code. The material of the plates 134 and 136 and for the truss hangars 144 and 146, for example, may be 18-14 gauge cold roll steel.

Figure 7:
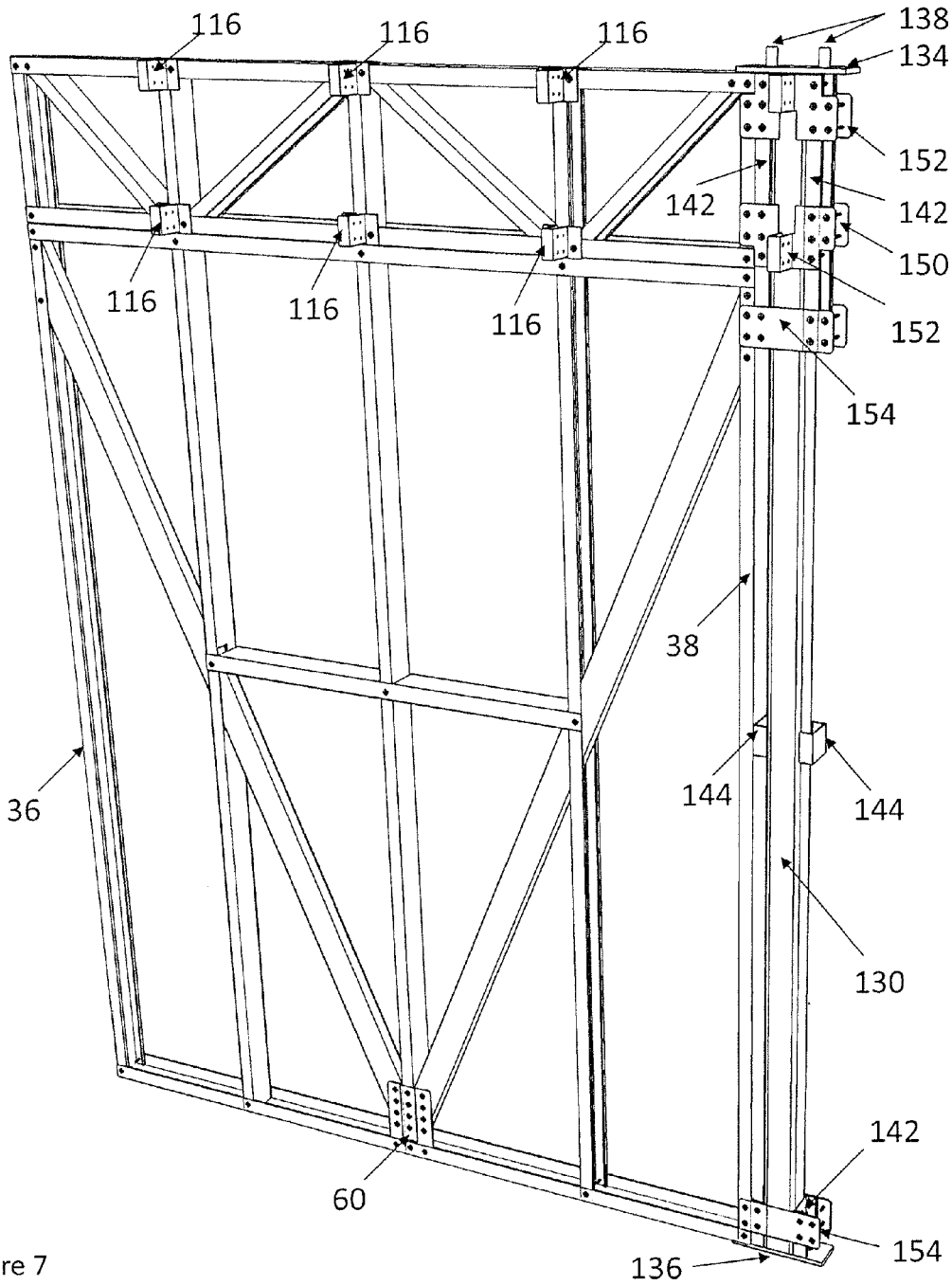
FIGS. 7 and 8 show the manner of attaching a horizontal truss panel such as shown in FIGS. 3, 3.1, 4, 4.1, and 4.2 to the structural column assembly of FIG. 6.
Figure 8:
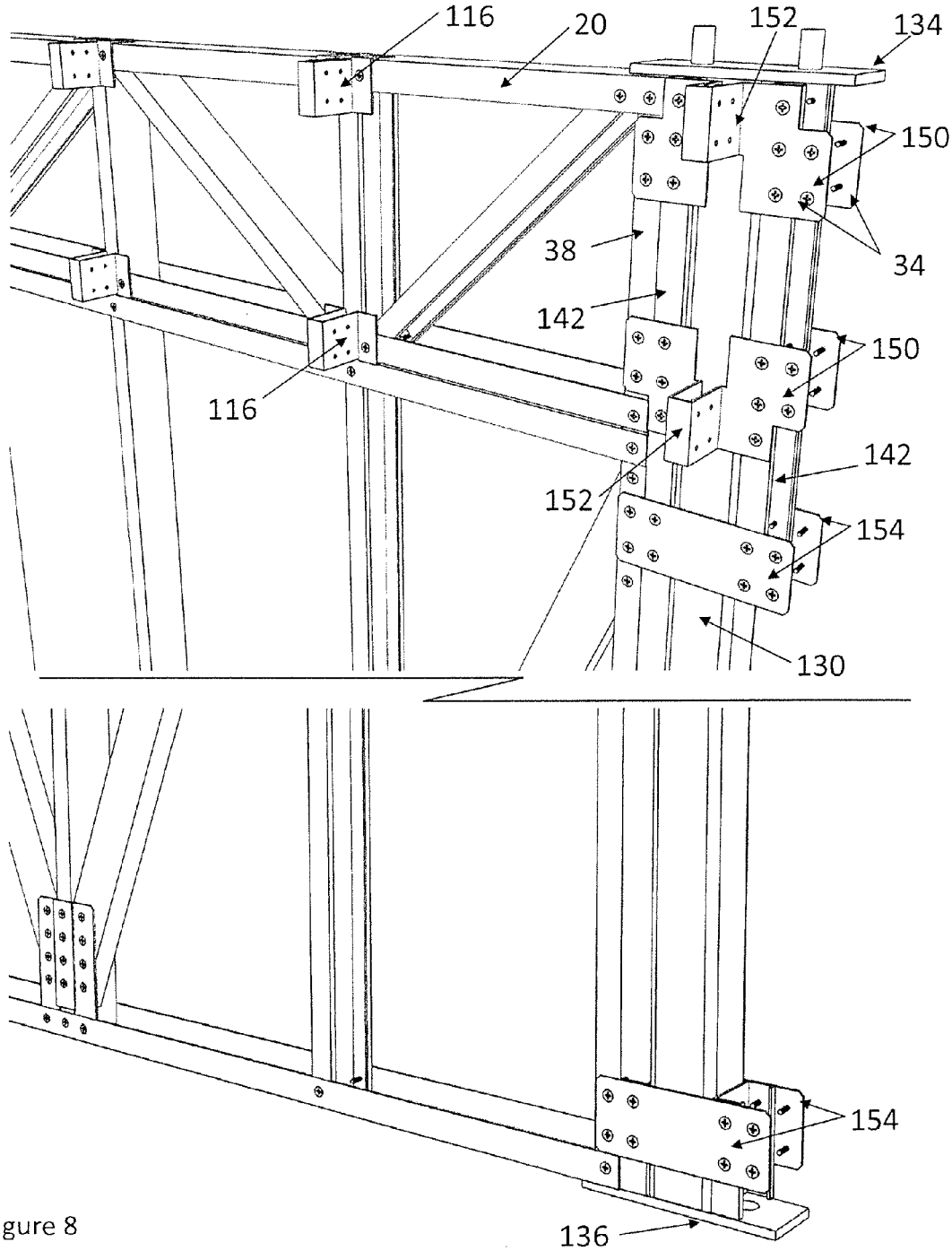

FIGS. 7 and 8 shows the manner of attaching a horizontal truss panel such as the horizontal truss panels 20, 22, and 24 to the structural column assembly 130. A unified horizontal truss panel is created when the structural column assembly 130 is attached to the horizontal truss panel 20/22/24 using four truss hanger unification plates 150, which have a stud insertion projection for attachment of the trusses 106 discussed in further detail below, and two flat unification plates 154, all of which are attached by fasteners 34 to the side stud 36 and 38 of the horizontal truss panel 20/22/24 and the stud sections 142. The stud sections 144 as shown in FIG. 7 act to "hold-off" studs 36 and 38 so that these studs do not deflect through the space between the side studs 36 and 38 and the structural column 132. Unification plates such as 154 may or may not be used at this location.

In a UTCS structure, a section or length of wall is assembled by attaching a number (depending on wall length) of horizontal truss panels together using the structural column assemblies 130. The open horizontal truss panels 24 are used as a wall section(s) in buildings where there are larger openings like windows, doors, and pass-throughs. The V-braced horizontal truss panels 22/22 are used as wall section(s) generally throughout the rest of the structure so as to provide dense lateral support of the structure.

Figure 9:
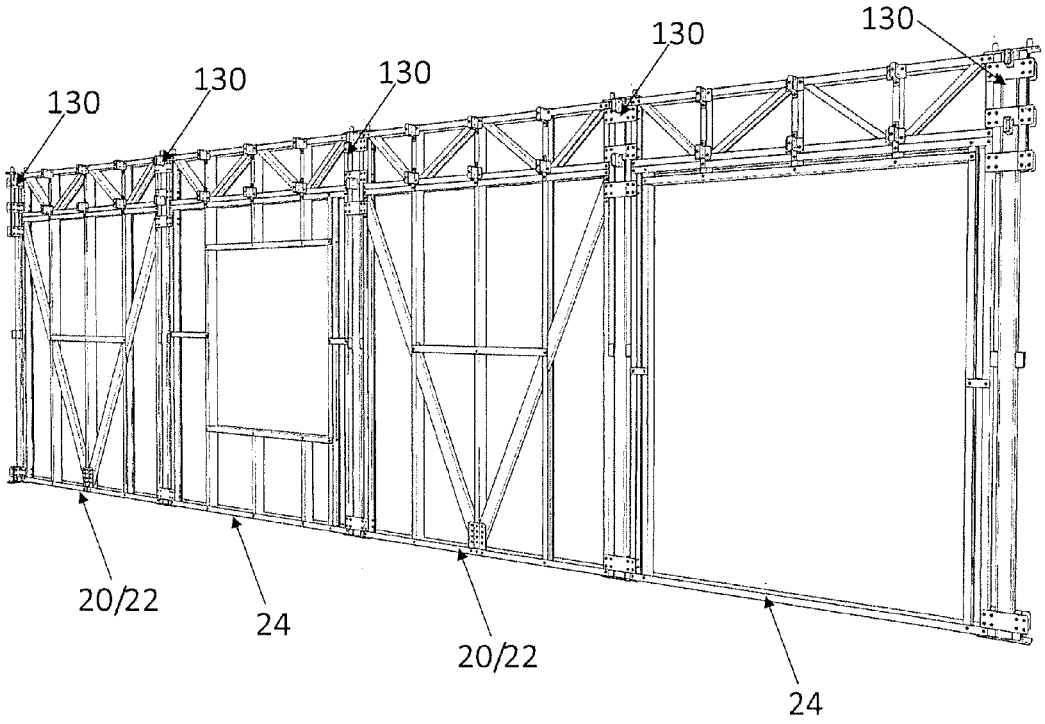
FIG. 9 shows a unified horizontal truss panel wall line having open and V-braced horizontal truss panels in a Unified Truss Construction System (UTCS) wall line.

FIG. 9 shows a horizontal truss panel wall line having open and V-braced horizontal truss panels 24 and 20/22 in a UTCS wall line.

Figure 11:
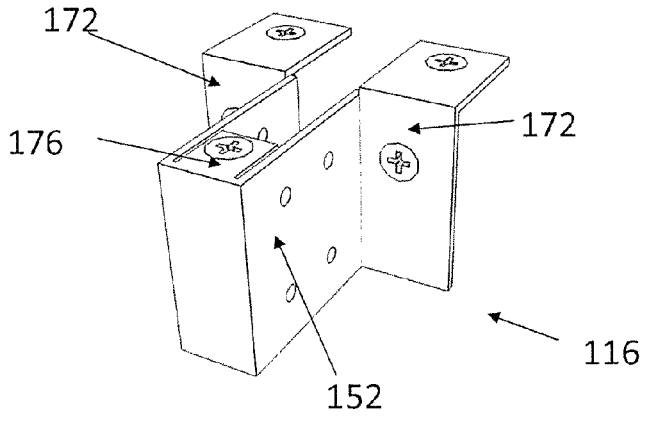
FIG. 11 shows the truss/stud hangar of FIG. 6.
Figure 12:
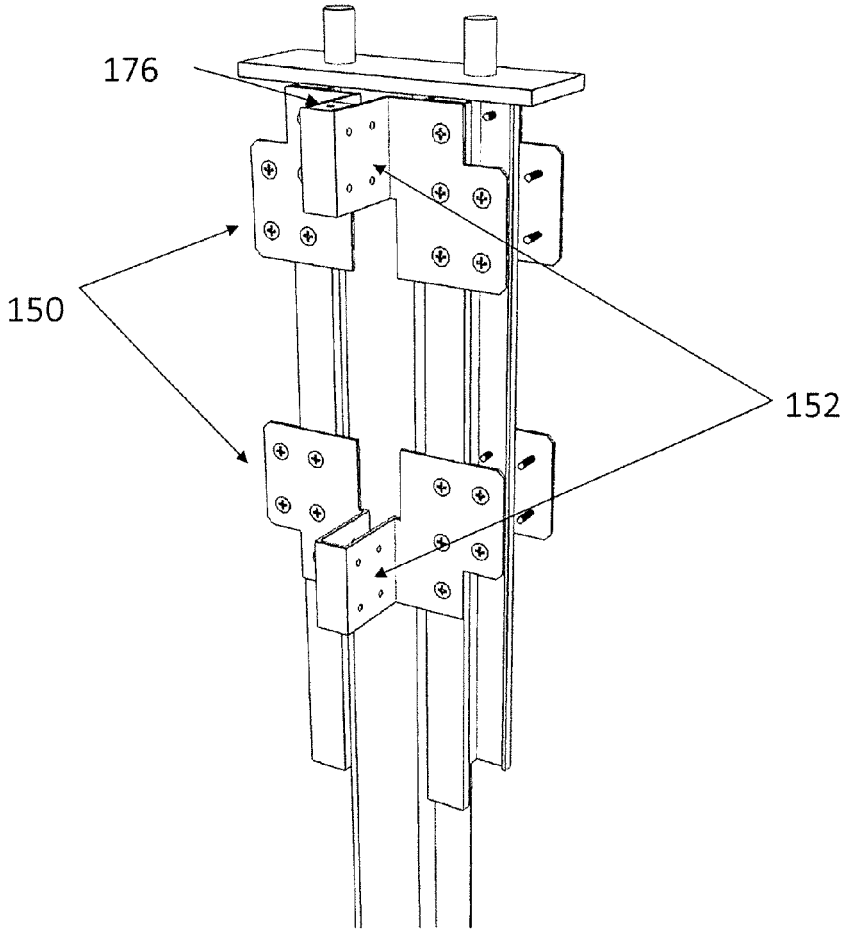
FIG. 12 illustrate a portion of the structural column assembly of FIG. 6.

As indicated above, the truss 106 is attached to the horizontal truss panel 20/22/24 by way of the truss/stud hangars 116 and the fasteners 34 located at the inboard studs 44 and 46 and the center stud 48. The truss/stud hangar 116 is shown in FIG. 11 and includes a stud insertion projection 152 to be received within the top stud 108 of the truss 106 as illustrated in FIG. 5 and, when inverted 180 degrees as illustrated in FIGS. 5 and 8, within the bottom stud 110 of the truss 106. The truss/stud hanger 116 also includes L-shaped flanges 172 used to fasten the truss/stud hangers to the top track 26 and, inverted, to the horizontal bracing 30 and 32 of the horizontal truss panels.

The trusses 106 are connected to the horizontal truss panels 20/22/24 by inserting the end of the top stud 108 of the truss 106 into the insertion projection 152 and fastening by fasteners 34, and connecting by fasteners 34 the L-shaped flanges 172 to the web 14 and flange 16 of the top track 26 and by connecting by fastener 34 a projection tab 176 of the truss hangar 116 to the top flange 16 of the stud 108. The bottom stud 110 of the truss 106 is connected by inverting the truss/stud hanger 116 by 180 degrees, inserting the end of the bottom stud 110 of the truss 106 into the insertion projection 152 and fastening by fasteners 34, connecting by fasteners 34 the L-shaped flanges 172 to the web 14 of the tracks 30 and 32, and by connecting by fastener 34 the projection tab 176 to the bottom flange 16 of the stud 110.

A truss 106 is also attached at each of the structural columns 132 by way of an insertion projection 152 on the unification plate 150. The end of the top stud 108 of the truss 106 is inserted over the insertion projection 152 of the unification plate 150 and fastened with fasteners 34 to the web 14 of the stud 108. The projection tab 176 is fastened by a fastener to the top flange 16 of the stud 108. The bottom stud 110 of the truss 106 is connected by way of insertion of the end of the stud 110 over the insertion projection 152 of a unification plate 150 that is rotated 180 degrees. Fasteners 34 are used to connect the insertion projection 152 to the web 14 of the stud 110. The projection tab 176 is attached by way of a fastener to the bottom flange 16 of the stud 110.

Figure 13:
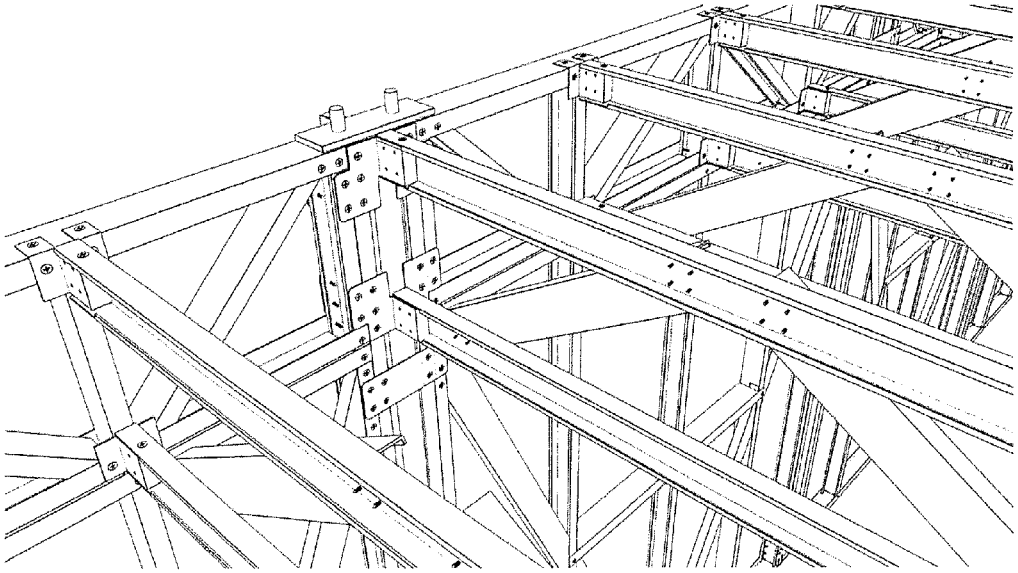
FIG. 13 illustrates trusses connected to horizontal truss panels.
Figure 13:
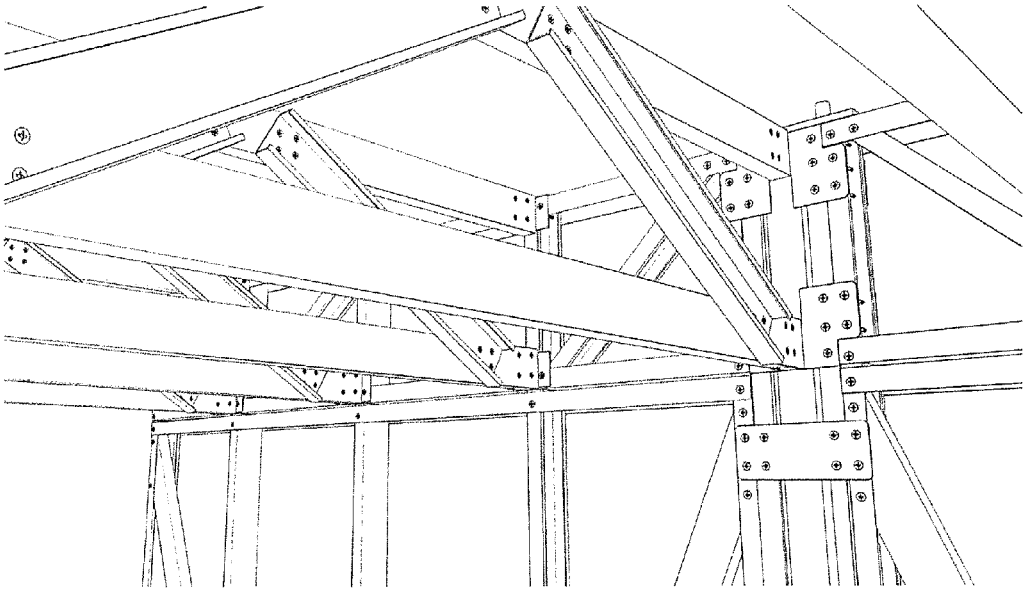

FIG. 13 illustrates the trusses 106 connected to horizontal truss panels 20/22/24.

Figure 14:
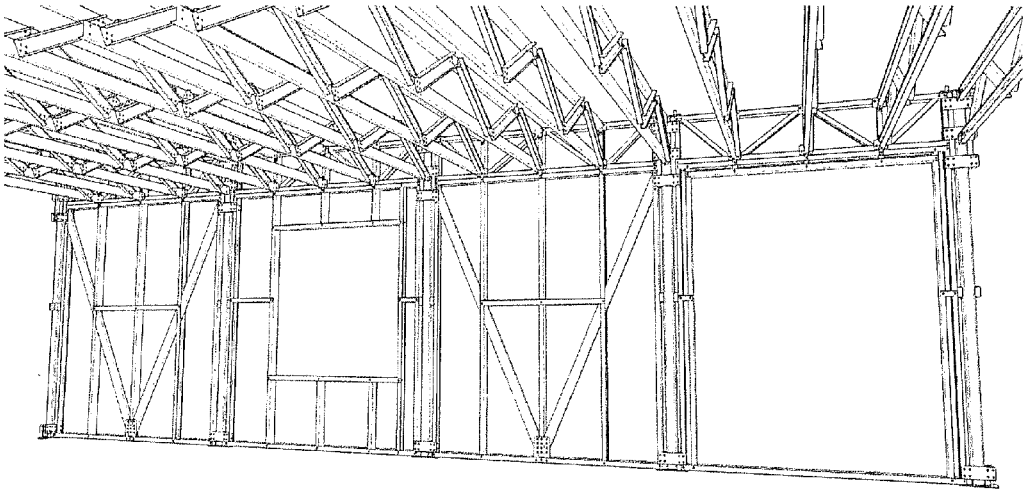
FIG. 14 illustrates trusses connected to horizontal truss panels to form a UTCS open span assembly creating a wall line.

FIG. 14 illustrates the trusses 106 connected to horizontal truss panels 20/22/24 forming a UTCS open span assembly where the horizontal truss panels 20/22/24 are assembled with the trusses 106 to create a wall line. The trusses 106 support a floor and ceiling assembly.

Attaching the trusses 106 to the horizontal truss panels in this manner incorporates the truss 106 into the horizontal truss panels 20/22/24, eliminating the "hinge-point" that exists where a wall assembly sits on a floor, or where a ceiling assembly sits on top of a wall. This connection unifies the trusses 106 and horizontal truss panels 20/22/24, in effect enabling the entire wall and floor system to act together as a "truss." This configuration facilitates the transfer of forces on the floor, ceiling, and horizontal truss panels 20/22/24 to their attached structural column assemblies 130. Accordingly, vertical and lateral forces are not transferred vertically horizontal truss panel to horizontal truss panel. When subflooring and drywall are incorporated into the building, the entire system acts as a "diaphragm."

Figure 15:
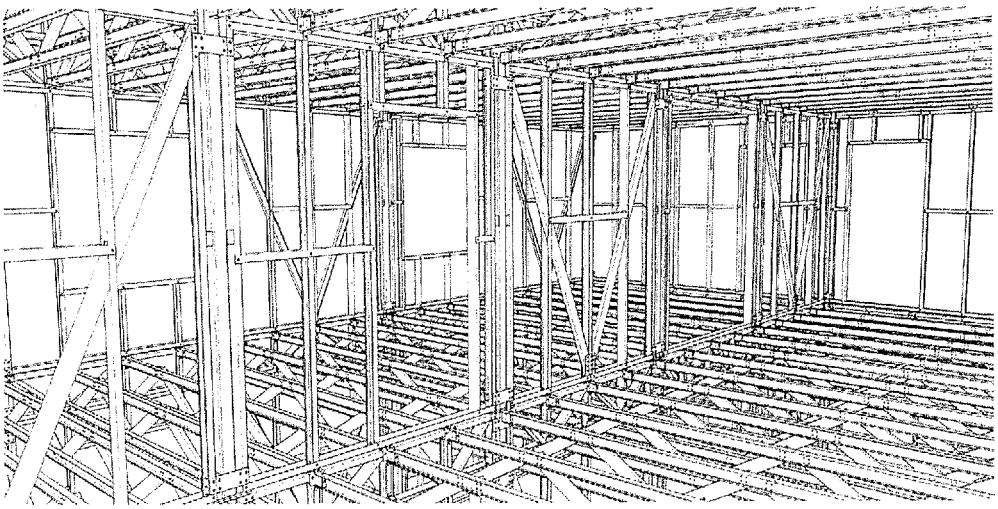
FIG. 15 illustrates a UTCS building section formed as an assembly of multiple floors of a UTCS structure.

FIG. 15 illustrates a UTCS building section formed as an assembly of multiple floors of a UTCS structure. In a UTCS building or structure, the horizontal truss panels 20/22/24 are laid out such that the structural column assemblies 130 on one floor line up vertically with the structural column assemblies 130 on the floor below, and so on, down to a foundation.

Figure 16:
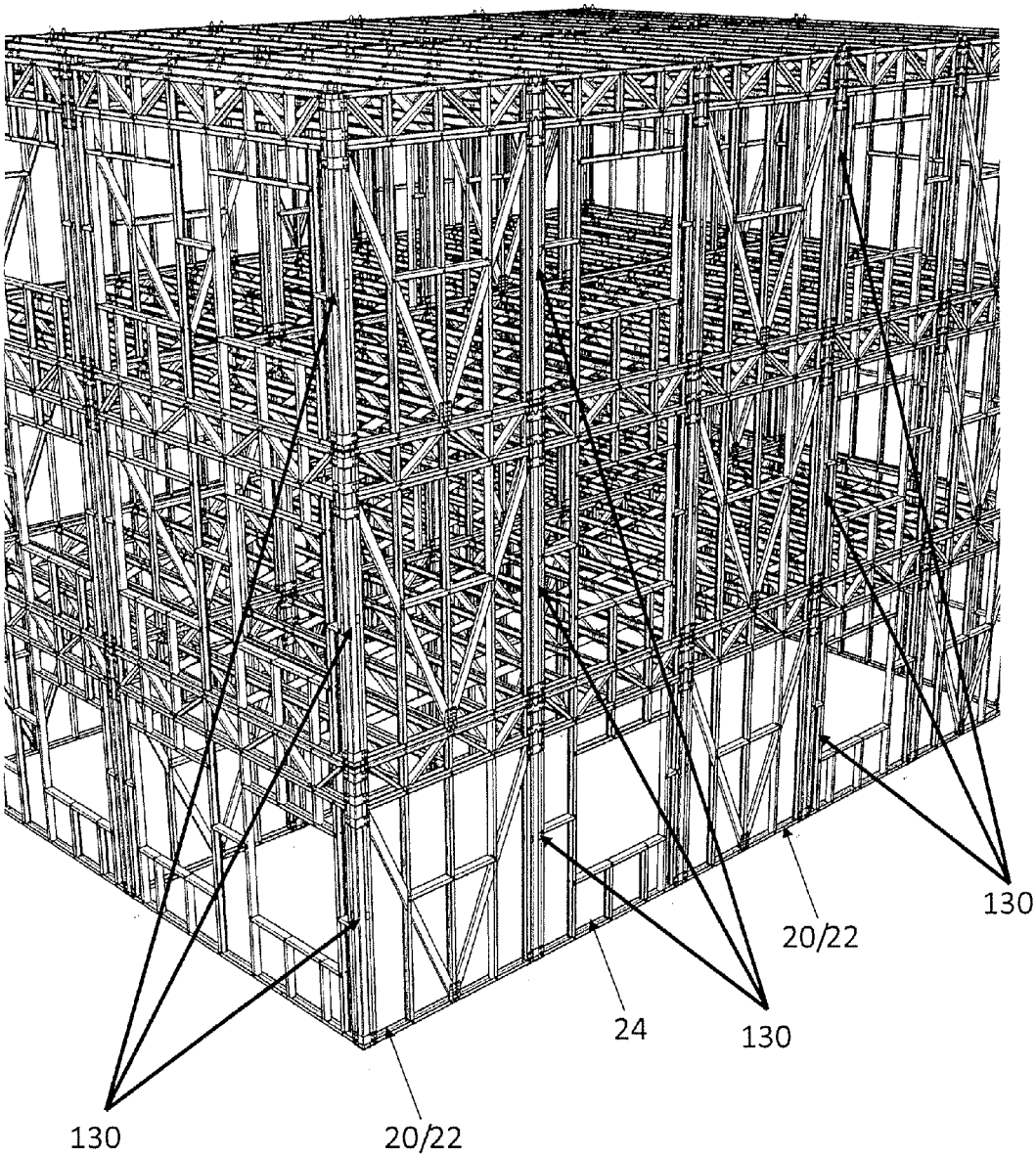
FIG. 16 shows alignment of the structural column assemblies of FIG. 6 in a building.

FIG. 16 shows this alignment of the structural column assemblies. FIG. 16 also illustrates the density of the structural column assemblies 130 in a UTCS structure.

Figure 17:
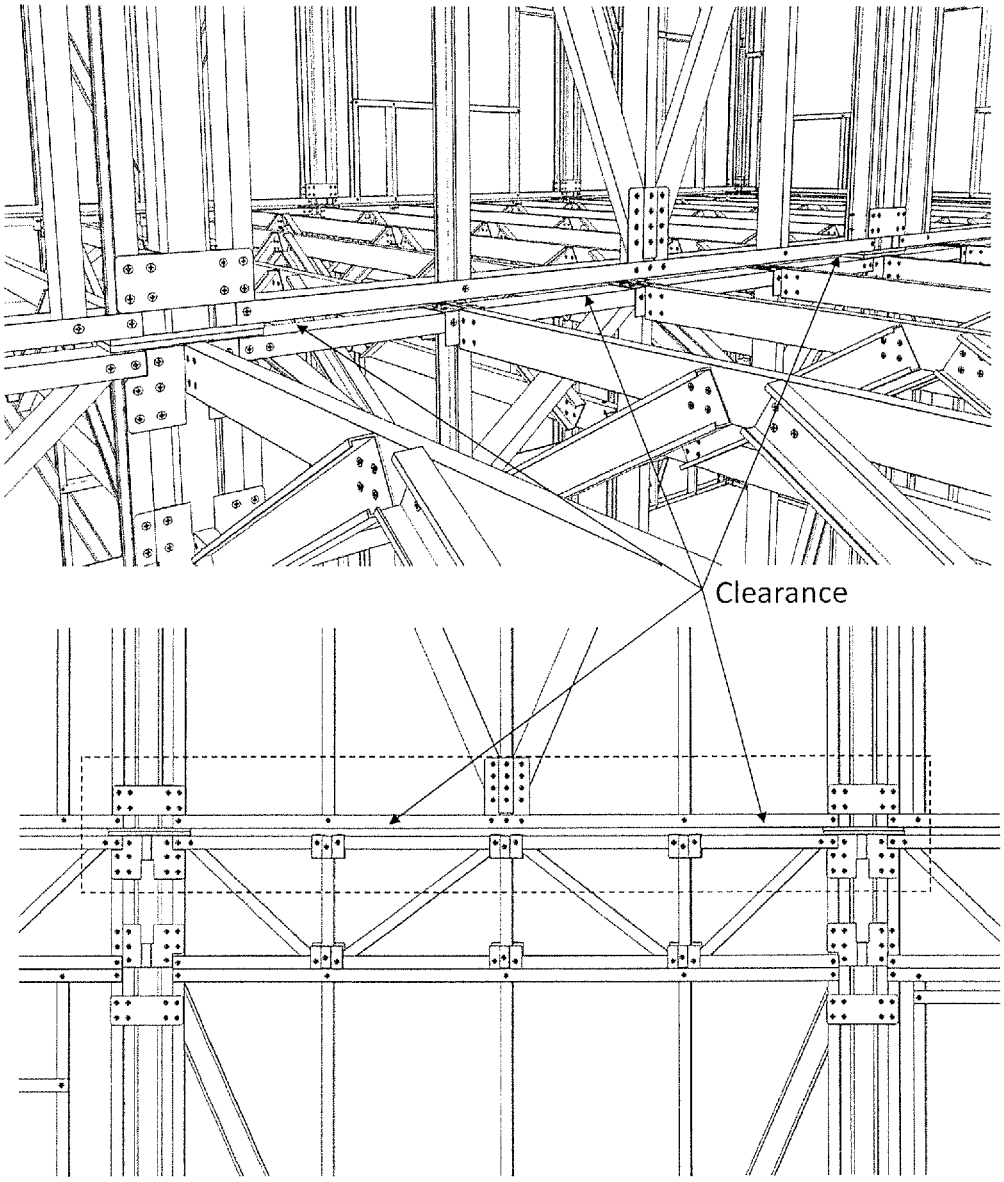
FIG. 17 illustrates a three-dimensional view and a two-dimensional view of the floor-to-floor sections of a section of this building; and, FIG. 18 shows the transfer of forces to the structural column assemblies of FIG. 6.

FIG. 17 illustrates a three-dimensional view and a two-dimensional view of the floor-to-floor joints of this assembly. It shows that horizontal truss panels 20/22/24 do not contact or bear on each other, as is otherwise typical in "bearing wall" and steel and concrete structures. The horizontal truss panels on one floor of a UTCS structure do not carry load from the floor above. This load is instead transferred to and carried by the structural column assemblies 130. Each "floor" or elevation of the structure dampens and transfers its vertical live and dead load forces to the structural column assemblies 130, where they are dampened and transferred vertically to the foundation of the building.

Figure 18:
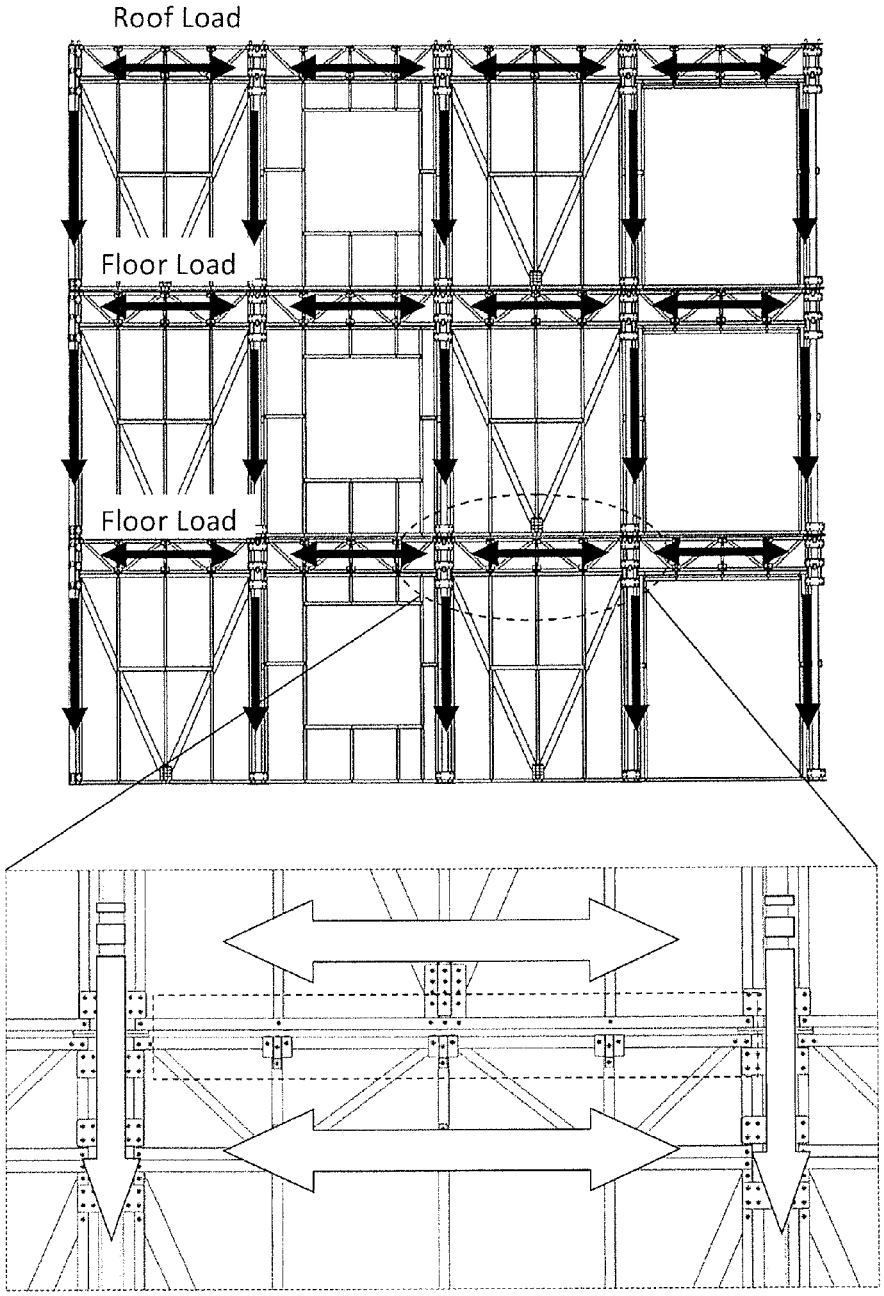

The V-braced horizontal truss panels 20/22 dampen and transfer the lateral forces acting on the building to the redundant structural column assemblies 130 in the structure. This transfer of forces is illustrated in FIG. 18. The blow up portion of FIG. 18 also illustrates that the panels do not bear on each other vertically and that the forces (arrows) are not transferred vertically from one panel to the other. Rather the vertical and lateral forces are transferred laterally to the structural column assemblies 130. This type of load transfer is facilitated by the unique design and assembly of the system. Both the horizontal truss panels 20/22/24 and the trusses 106 act as a unified truss system.

UTCS may employ horizontal truss panels of varying widths from 20' to 2', the most common being V-braced horizontal truss panels 20/22 measuring 8' and 4'. These panels lead to a significant redundancy of the structural column assemblies 130 within the structure. Each open horizontal truss panel 24 acts to support and mitigate only those vertical local forces proximate to their attached structural column assemblies 130. The V-braced horizontal truss panels 20/22 act to support vertical local forces as well as lateral forces acting on the structure. Because of the unique manner in which the horizontal truss panels 20/22/24 transfer vertical and lateral forces and the redundancy of the structural column assemblies 130 in the system, there in no need to configure panels differently from floor-to-floor. Only the width and gauge of the tracks 12, the studs 10, and V-brace vary, depending on building height and code requirements.

Interior non-structural partition walls that separate spaces within a UTCS building are constructed from light gauge steel (typically 24-28 gauge) and are typical in Type I and Type II steel frame construction.

UTCS is extremely efficient in managing vertical and lateral forces on a building. With UTCS the need to build a bearing wall structure or heavy structural core is eliminated, vastly reducing costs over traditional construction practices. UTCS saves time as well because the structure of a building is erected from a limited number of pre-assembled panels. This also dramatically reduces the cost of engineering the structure of buildings.

UTCS is unique and innovative. It can be built on nearly any foundation system including slabs, structured parking, retail and commercial buildings. UTCS employs a framing technology that is based on a system-built, panelized approach to construction. UTCS uses panelized building technology and innovative engineering to significantly reduce the cost of design, material, and erection of a building. UTCS technology and engineering is a new structural system and method of assembling single and multistory buildings.

Certain modifications of the present invention have been discussed above. For example, although the present invention is particularly useful for constructing and assembling buildings without relying on concrete and/or structural steel framing, heavy steel let-in bracing, and heavy steel and/or concrete panels, it can also be applied to buildings having concrete and/or structural steel framing, heavy steel let-in bracing, and heavy steel and/or concrete panels. Other modifications will occur to those practicing in the art of the present invention. Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

We claim:

1. A building section comprising:

a first structural column having a top connector and a bottom connector;

a second structural column having a top connector and a bottom connector, wherein the top connector of the first structural column is connected to the bottom connector of the second structural column so that the first and second structural columns align vertically;

a first structural truss panel attached to the first structural column; and, a second structural truss panel attached to the second structural column such that the first and second structural truss panels transfer loads on the first and second structural truss panels laterally to the first and second structural columns and then vertically through the first and second structural columns, wherein a clearance exists between the first and second structural truss panels and between the first and second structural truss panels and any floor connected to the first and second structural truss panels such that load is not transferred between the first and second structural truss panels.

2. The building section of claim 1 wherein the bottom connector of each of the first and second structural columns comprises a bottom connector plate having at least one hole extending therethrough, wherein the top connector of each of the first and second structural columns comprises a top connector plate having at least one fastener projecting upwardly therefrom, and wherein hole of the bottom connector plate of the second structural column receives the at least one fastener of the top connector plate of the first structural column for fastening the first and second structural columns together.

3. The building section of claim 2 further comprising first and second stud sections and first and second attachment plates, wherein the first stud section is attached to the first structural column, wherein the second stud section is attached to the second structural column, wherein the first attachment plate fastens the first structural truss panel to the first stud section, and wherein the second attachment plate fastens the second structural truss panel to the second stud section.

4. The building section of claim 3 wherein each of the first and second stud sections comprises a web, first and second flanges, and first and second lips, wherein the first and second flanges extend in the same direction at substantially right angles from opposing sides of the web, and wherein the first and second lips extend inwardly from ends of the first and second flanges such that each of the first and second lips is parallel to the web.

5. The building section of claim 3 further comprising:

a third structural truss panel attached to the first structural column;

a fourth structural truss panel attached to the second structural column such that the third and fourth structural truss panels align vertically and such that a clearance exists between the third and fourth structural truss panels so that load is transferred through the first and second structural columns rather than between the third and fourth structural truss panels; and, third and fourth stud sections, wherein the third stud section is attached to the first structural column, wherein the fourth stud section is attached to the second structural column, wherein the first attachment plate fastens the third structural truss panel to the first stud section facilitating the transfer of load acting on the third structural truss panel through the third stud section to the first structural column, and wherein the second attachment plate fastens the fourth structural truss panel to the second stud section facilitating the transfer of load acting on the fourth structural truss panel through the fourth stud section to the second structural column.

6. An integrated structural truss panel configured to laterally transfer load to a structural column in a building, the integrated structural truss panel comprising:

first, second, third, and fourth horizontal elongated members;

first and second vertical elongated members fastened to the first, second, third, and fourth horizontal elongated members such that the first and fourth horizontal elongated members form respectively a top and a bottom of the structural truss panel, such that the first and second vertical elongated members form respective sides of the structural truss panel, such that first, second, and third horizontal elongated members form an integrated web truss for attachment to floor and/or ceiling trusses, and such that the second and third horizontal elongated members form a double horizontal brace that connects to each of the first and second vertical elongated members and that bridges between the first and second vertical elongated members forming sides of the structural truss panel, the first and second vertical elongated members each being a unitary member formed in one piece and extending from the top to the bottom of the structural truss panel; and, an angled webbing fastened between the first and second vertical elongated members and the first and second horizontal elongated members thereby creating an integrated web truss within the structural truss panel whereby the integrated web truss acts as a transfer beam and facilitates the lateral transfer of load on the structural truss panel to the structural column.

7. The integrated truss panel of claim 6 wherein the first, second, third, and fourth elongated members comprise corresponding first, second, third, and fourth tracks, wherein each of the first, second, third, and fourth tracks comprises a track web, first and second track flanges, and first and second track lips, wherein the first and second track flanges extend in a same direction at substantially right angles from opposing sides of the track web, and wherein the first and second track lips extend inwardly from ends of the first and second track flanges such that each of the first and second track lips is parallel to the track web, and further wherein the first and second vertical elongated members comprise corresponding first and second studs, wherein each of first and second studs comprises a stud web, first and second stud flanges, and first and second stud lips, wherein the first and second stud flanges extend in a same direction at substantially right angles from opposing sides of the stud web, wherein the first and second stud lips extend inwardly from ends of the first and second stud flanges such that the first and second stud lips parallel the stud web, and wherein the track web has a width that is wider than a width of the stud web such the first and second studs can be fitted within the first, second, third, and fourth tracks.

8. The integrated truss panel of claim 7 wherein each of the first, second, third, and fourth tracks and each of the first and second studs comprises light gauge steel of between 18 and 14 gauge inclusive.

9. The integrated truss panel of claim 6, wherein the integrated structural truss panel further comprises third, fourth, and fifth vertical elongated members fastened to the first, second, third, and fourth horizontal elongated members such that the fourth vertical elongated member is substantially centered between the first and second vertical elongated members, such that third vertical elongated member is between the first and fourth vertical elongated members, and such that the fifth vertical elongated member is between the fourth and second vertical elongated members, the third, fourth, and fifth vertical elongated members extending through openings in the second and third horizontal elongated members so that each of the third, fourth and fifth vertical elongated members extends from the top of the structural truss panel through the double horizontal brace.

10. The integrated structural truss panel of claim 9 wherein the first, second, third, and fourth horizontal elongated members comprise corresponding first, second, third, and fourth tracks, wherein each of first, second, third, and fourth tracks comprises a track web, first and second track flanges, and first and second track lips, wherein the first and second track flanges extend in a same direction at substantially right angles from opposing sides of the track web, and wherein the first and second track lips extend inwardly from ends of the first and second track flanges such that each of the first and second track lips is parallel to the track web;

and further wherein the first, second, third, fourth, and fifth vertical elongated members comprise corresponding first, second, third, fourth, and fifth studs, wherein each of first, second, third, fourth, and fifth studs comprises a stud web, first and second stud flanges, and first and second stud lips, wherein the first and second stud flanges extend in a same direction at substantially right angles from opposing sides of the stud web, wherein the first and second stud lips extend inwardly from ends of the first and second stud flanges such that each of the first and second stud lips is parallel to the stud web, and wherein the track web has a width that is wider than a width of the stud web such the first, second, third, fourth, and fifth studs can be fitted within the first, second, third, and fourth tracks.

11. The integrated structural truss panel of claim 10 wherein each of the first, second, third, and fourth tracks and each of the first, second, third, fourth, and fifth studs comprises light gauge steel of between 18 and 14 gauge inclusive.

12. The integrated structural truss panel of claim 9 further comprising:

a first brace member fastened to the first and third vertical elongated members and to the fourth horizontal elongated member; and, a second brace member fastened to the second and fifth vertical elongated members and to the fourth horizontal elongated member, wherein the first and second brace member form an integrated V-brace in the structural truss panel configured to laterally transfer load on the structural truss panel to the structural column.

13. The integrated structural truss panel of claim 12 further comprising a third brace member between the third and fifth vertical elongated members and fastened to the third, fourth, and fifth vertical elongated members.

14. The integrated structural truss panel of claim 6 further comprising:

a first truss hangar fastened to the first horizontal elongated member, wherein the first truss hangar is arranged to fasten to a ceiling truss or a floor truss at a side of the integrated structural truss panel between a continuous double horizontal brace and the first horizontal elongated member; and, a second truss hangar fastened to at least one of the third and second horizontal elongated member, wherein the second truss hangar is arranged to fasten to the ceiling or floor truss at a side of the integrated structural truss panel between the continuous double horizontal brace and the first horizontal elongated member.

15. The integrated structural truss panel of claim 14 wherein the ceiling or floor truss comprises:

a first horizontal truss member fastened to the first truss hangar;

a second horizontal truss member fastened to the second truss hangar; and, a plurality of angled members fastened to the first and horizontal truss members.

16. The integrated structural truss panel of claim 15 wherein each of the first and second horizontal elongated members and the angled members comprises a stud having a stud web, first and second stud flanges, and first and second stud lips, wherein the first and second stud flanges extend in a same direction at substantially right angles from opposing sides of the stud web, and wherein the first and second stud lips extend inwardly from ends of the first and second stud flanges such that each of the first and second stud lips is parallel to the stud web.

17. The integrated structural truss panel of claim 6 wherein each of the first, second, third, and fourth horizontal elongated members and each of the first and second vertical elongated member comprises light gauge steel of between 18 and 14 gauge inclusive.

18. A structural panel for a building comprising:

first, second, third, and fourth horizontal elongated members;

first and second vertical elongated members fastened to the first, second, third, and fourth horizontal elongated members such that the first and fourth horizontal elongated members form respectively a top and a bottom of the structural panel, such that the first and second vertical elongated members form respective sides of the structural panel, and such that the second and third horizontal elongated members form a continuous double horizontal brace that connects at each of the first and second vertical elongated members and that bridges between the first and second vertical elongated members that form the sides of the structural panel, the first and second vertical elongated members each being a unitary member formed in one piece and extending from the top to the bottom of the structural truss panel; and, wherein at least one of the horizontal and vertical elongated members comprises a stud, wherein at least another one of the horizontal and vertical elongated members comprises a track, wherein the track comprises a track web and first and second track flanges, wherein the first and second track flanges extend in a same direction at substantially right angles from opposing sides of the track web, wherein the stud comprises a stud web and first and second stud flanges, wherein the first and second stud flanges extend in a same direction at substantially right angles from opposing sides of the stud web, and wherein the track web has a width that is wider than a width of the stud web such the stud can be fitted within the track.

19. The structural panel of claim 18 wherein the track further comprises first and second track lips, wherein the first and second track lips extend inwardly from ends of the first and second track flanges such that each of the first and second track lips is parallel to the track web, wherein the stud further comprises first and second stud lips, and wherein the first and second stud lips extend inwardly from ends of the first and second stud flanges such that each of the first and second stud lips is parallel to the stud web.

20. The structural panel of claim 18 wherein each of the track and the stud comprises light gauge steel of between 18 and 14 gauge inclusive.

21. The structural panel of claim 18 further comprising third, fourth, and fifth vertical elongated members fastened to the first, second, third, and fourth horizontal elongated members such that fourth vertical elongated member is substantially centered between the first and second vertical elongated members, such that the third vertical elongated member is between the first and fourth vertical elongated members, and such that the fifth vertical elongated member is between the fourth and second vertical elongated members.

22. The structural panel of claim 21 further comprising:

a first brace member fastened to first and third vertical elongated members and to the fourth horizontal elongated member; and, a second brace member fastened to second and fifth vertical elongated members and to the fourth horizontal elongated member, wherein the first and second brace members form an integrated V-brace in the structural panel configured to transfer lateral loads on the structural panel to a structural column.

23. The structural panel of claim 22 further comprising a third brace member between the third and fifth vertical elongated members and fastened to the third, fourth, and fifth vertical elongated members.

24. A method of constructing a building comprising:

fastening a first structural truss panel to a first structural column;

fastening a second structural column vertically to the first structural column; and, fastening a second structural truss panel to the second structural column so that the second structural truss panel is vertically above the first structural truss panel, so that a clearance is defined between the first and second structural truss panels, and so that loads on the structural truss panels are transferred from the first and second structural truss panels to the first and second structural columns and then vertically between the first and second columns.

25. The method of claim 24 further comprising:

fastening a third structural truss panel to the first structural column; and, fastening a fourth structural truss panel to the second structural column so that the fourth structural truss panel is vertically above the third structural truss panel, so that a clearance is defined between the third and fourth structural truss panels, and so that loads on the third and fourth structural truss panels are transferred from the third and fourth structural truss panels to the first and second structural columns.

26. The method of claim 24 further comprising:

fastening a first floor and/or ceiling truss to an integrated truss portion of the first structural truss panel so that the first floor and/or ceiling truss supports a member comprising a ceiling of a first space defined at least partially by the first structural truss panel and a floor of a second space defined at least partially by the second structural truss panel; and, fastening a second floor and/or ceiling truss to an integrated truss portion of the second structural truss panel so that the second floor and/or ceiling truss supports a member comprising a ceiling of the second space and a floor of a third space above the second space.

27. The method of claim 24 further comprising:

fastening a third structural column vertically to the second structural column;

fastening a third structural truss panel to the third structural column vertically above the second structural truss panel;

fastening a fourth structural column vertically to the third structural column;

fastening a fourth structural truss panel to the fourth structural column vertically above the third structural truss panel;

fastening a fifth structural column vertically to the fourth structural column;

fastening a fifth structural truss panel to the fifth structural column vertically above the fourth structural truss panel;

fastening a sixth structural column vertically to the fifth structural column; and, fastening a sixth structural truss panel to the sixth structural column vertically above the fifth structural truss panel, wherein there is clearance between the first, second, third, fourth, fifth, and sixth structural truss panels so that vertical and lateral forces on the first, second, third, fourth, fifth, and sixth structural truss panels are transferred laterally from the first, second, third, fourth, fifth, and sixth structural truss panels to the first, second, third, fourth, fifth, and sixth structural columns and then vertically downward.

28. The method of claim 27 wherein all of the structural truss panels are constructed from studs comprising light gauge steel of between 18 and 14 gauge inclusive.

29. The method of claim 28 wherein each of the studs comprises a stud web, first and second stud flanges, and first and second stud lips, wherein the first and second stud flanges extend in a same direction at substantially right angles from opposing sides of the stud web, wherein the first and second stud lips extend inwardly from ends of the first and second stud flanges such that each of the first and second stud lips is parallel to the stud web.

30. A method of constructing a building comprising:

fastening a first unified structural truss panel to a second unified structural truss panel, wherein the first unified structural truss panel comprises a first structural truss panel and a first structural column, wherein the second unified structural truss panel comprises a second structural truss panel and a second structural column, and wherein the first unified structural truss panel is fastened to the second unified structural truss panel by vertically fastening the first structural column to the second structural column;

fastening a third unified structural truss panel to a fourth unified structural truss panel, wherein the third unified structural truss panel comprises a third structural truss panel and a third structural column, and wherein the third unified structural truss panel is fastened to the second unified structural truss panel by fastening the third structural column vertically to the second structural column;

fastening the third structural column vertically to the first structural column so that the third structural truss panel is vertically above the first structural truss panel to define a clearance between the first and third structural truss panels; and, fastening the fourth structural column vertically to the second structural column so that the fourth structural truss panel is vertically above the second structural truss panel to define a clearance between the second and third structural truss panels, and so that loads on the structural truss panels are transferred from the structural truss panels to the structural columns and not vertically between the structural truss panels.

31. The method of claim 30 further comprising:

fastening a first floor and/or ceiling truss to the first structural truss panel so that the first floor and/or ceiling truss supports a member comprising a ceiling of a first space defined at least partially by the first structural truss panel and a floor of a second space defined at least partially by the second structural truss panel; and, fastening a second floor and/or ceiling truss to the second structural truss panel so that the second floor and/or ceiling truss supports a member comprising a ceiling of the second space and a floor of a third space above the second space.

32. The method of claim 30 wherein the structural truss panels are constructed from studs comprising light gauge steel of between 18 and 14 gauge inclusive.

33. The method of claim 32 wherein each of the studs comprises a stud web, first and second stud flanges, and first and second stud lips, wherein the first and second stud flanges extend in a same direction at substantially right angles from opposing sides of the stud web, wherein the first and second stud lips extend inwardly from ends of the first and second stud flanges such that each of the first and second stud lips is parallel to the stud web.

34. The building section of claim 1 wherein first and second structural truss panels comprise framing members roll-formed from 18 to 14, inclusive, gauge steel.

* * * * *